US008590293B2

(12) United States Patent
Nishioka et al.

(10) Patent No.: US 8,590,293 B2
(45) Date of Patent: Nov. 26, 2013

(54) EXHAUST EMISSION PURIFIER OF INTERNAL COMBUSTION ENGINE

(75) Inventors: Hiromasa Nishioka, Susono (JP); Yoshihisa Tsukamoto, Susono (JP); Kazuhiro Umemoto, Susono (JP); Junichi Matsuo, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 47 days.

(21) Appl. No.: 13/395,316

(22) PCT Filed: Oct. 21, 2009

(86) PCT No.: PCT/JP2009/068445
§ 371 (c)(1),
(2), (4) Date: Mar. 9, 2012

(87) PCT Pub. No.: WO2011/048703
PCT Pub. Date: Apr. 28, 2011

(65) Prior Publication Data
US 2012/0198824 A1 Aug. 9, 2012

(51) Int. Cl.
*F01N 3/00* (2006.01)
*F01N 3/10* (2006.01)

(52) U.S. Cl.
USPC ..... 60/295; 60/285; 60/287; 60/292; 60/297; 60/301

(58) Field of Classification Search
USPC ..... 60/285, 287, 292, 295, 297, 301, 311
See application file for complete search history.

(56) References Cited

U.S. PATENT DOCUMENTS

| | | | | |
|---|---|---|---|---|
| 5,180,567 | A | 1/1993 | Yoshimoto et al. | |
| 2004/0116276 | A1 * | 6/2004 | Yezerets et al. | 502/34 |
| 2006/0230748 | A1 | 10/2006 | Dalla Betta et al. | |

FOREIGN PATENT DOCUMENTS

| | | |
|---|---|---|
| JP | A-3-72916 | 3/1991 |
| JP | A-2001-20720 | 1/2001 |
| JP | A-2004-84638 | 3/2004 |
| JP | A-2005-344617 | 12/2005 |
| JP | A-2006-57478 | 3/2006 |
| JP | A-2008-64067 | 3/2008 |
| JP | A-2008-238059 | 10/2008 |
| JP | A-2009-168031 | 7/2009 |

OTHER PUBLICATIONS

International Search Report dated Jan. 26, 2010 in International Application No. PCT/JP2009/068445 (with translation).

* cited by examiner

*Primary Examiner* — Kennth Bomberg
*Assistant Examiner* — Audrey K Bradley
(74) *Attorney, Agent, or Firm* — Oliff & Berridge, PLC

(57) ABSTRACT

The exhaust purification system of an internal combustion engine of the present invention is provided with an $NO_X$ storage reduction catalyst and a particulate filter which is arranged at the upstream side of the $NO_X$ storage reduction catalyst. When causing the $NO_X$ storage reduction catalyst to release the stored $NO_X$, the particulate filter is raised to the temperature at which the particulate matter is oxidized, the flow rate of the exhaust gas which flows into the particulate filter is made to decrease, the air-fuel ratio of the exhaust gas which flows into the particulate filter is made rich, and the particulate matter which builds up on the particulate filter is made to oxidize to produce carbon monoxide.

6 Claims, 20 Drawing Sheets

EXHAUST EMISSION PURIFIER OF INTERNAL COMBUSTION ENGINE

TECHNICAL FIELD

The present invention relates to an exhaust purification system of an internal combustion engine.

BACKGROUND ART

A diesel engine or other internal combustion engine burns fuel in the engine body and produces exhaust which contains pollutants. The pollutants of exhaust gas include carbon monoxide (CO), unburned hydrocarbons (HC) and particulate matter (PM) and also nitrogen oxides ($NO_X$). As one method which removes nitrogen oxides, it is known to place a device which reduces the $NO_X$ in the engine exhaust passage.

Devices which reduce $NO_X$ include an $NO_X$ storage reduction catalyst which temporarily stores $NO_X$. An $NO_X$ storage reduction catalyst stores $NO_X$ when the air-fuel ratio of the exhaust gas is large, that is, when the air-fuel ratio of the exhaust gas is lean. As opposed to this, when the air-fuel ratio of the exhaust gas is small, that is, when the air-fuel ratio of the exhaust gas is rich, it releases the stored $NO_X$. The $NO_X$ is removed by reduction by a reducing agent which is contained in the exhaust gas.

Japanese Patent Publication (A) No. 2004-84638 discloses a method of treatment of engine exhaust gas which includes a step of using a plasma generator to convert part of the exhaust gas components to an oxidant component and uses the oxidant component to make the carbon component in the exhaust gas oxidize and thereby produce carbon monoxide and a step of reducing the $NO_X$ in the exhaust gas by the reduction action of carbon monoxide on a denitridation catalyst.

Japanese Patent Publication (A) No. 2006-57478 discloses a device for regeneration of an exhaust purification member which is provided with a burner which injects combustion gas at the upstream side of the $NO_X$ storage reduction catalyst. This regeneration device makes fuel incompletely burn at the burner and injects combustion gas made to increase in the content of carbon monoxide or the content of fuel gas so as to regenerate the exhaust purification member.

Further, devices which reduce $NO_X$ which is contained in exhaust gas include an $NO_X$ catalyst which causes continuous reaction of $NO_X$ and a reducing agent.

Japanese Patent Publication (A) No. 2001-20720 discloses an exhaust purification system which is provided with a filter which is arranged in an exhaust passage of a diesel engine and a weak oxidizing strength catalyst and $NO_X$ reduction catalyst which are carried on the filter and which arranges a weak oxidizing strength catalyst at an upstream side of the $NO_X$ reduction catalyst. In the exhaust which passes through the filter, the weak oxidizing strength catalyst causes partial oxidation of the hydrocarbons to be promoted resulting in the carbon monoxide and aldehyde ratio becoming higher. Further, it is disclosed that by this exhaust passing through the $NO_X$ reduction catalyst, a high reduction efficiency of nitrogen oxides is obtained.

Japanese Patent Publication (A) No. 3-72916 discloses a method of treatment of exhaust gas which passes exhaust gas through a catalyst layer by a surface area speed of 100 to 5000 $m^3/m^2 \cdot hr$ to thereby selectively produce carbon monoxide from the particulate which is contained in the exhaust gas and which uses the carbon monoxide to remove the nitrogen oxides in the exhaust gas.

Further, Japanese Patent Publication (A) No. 2008-238059 discloses a device which is comprised of a catalyst, including a carrier and a chloride of an alkali metal or alkali earth metal or other catalyst component, carried on a diesel particulate filter.

CITATIONS LIST

Patent Literature

PLT 1: Japanese Patent Publication (A) No. 2004-84638
PLT 2: Japanese Patent Publication (A) No. 2006-57478
PLT 3: Japanese Patent Publication (A) No. 2001-20720
PLT 4: Japanese Patent Publication (A) No. 3-72916
PLT 5: Japanese Patent Publication (A) No. 2008-238059

SUMMARY OF INVENTION

Technical Problem

An $NO_X$ storage reduction catalyst gradually experiences buildup of $NO_X$ when being continuously used. Further, $SO_X$ is stored when $SO_X$ is contained in the exhaust gas which flows into the $NO_X$ storage reduction catalyst. An $NO_X$ storage reduction catalyst is treated to release the $NO_X$ or $SO_X$ to regenerate it. When performing treatment for regeneration, the air-fuel ratio of the exhaust gas which flows into the $NO_X$ storage reduction catalyst is made the stoichiometric air-fuel ratio or rich.

When causing the $NO_X$ storage reduction catalyst to release the $NO_X$, for example, unburned fuel is supplied to the engine exhaust passage to thereby make the air-fuel ratio of the exhaust gas which flows into the $NO_X$ storage reduction catalyst rich. Fuel is required for the release and reduction of $NO_X$.

When causing the $NO_X$ storage reduction catalyst to release $SO_X$, the $NO_X$ storage reduction catalyst is made a high temperature. In the rise of temperature of the $NO_X$ storage reduction catalyst, for example, an exhaust treatment device which carries a precious metal catalyst is arranged at the upstream side of the $NO_X$ storage reduction catalyst and unburned fuel is supplied to this exhaust treatment device to thereby make the temperature of the exhaust gas rise. When the temperature of the $NO_X$ storage reduction catalyst reaches the temperature at which it can release $SO_X$, for example, unburned fuel is supplied to the engine exhaust passage so as to make the air-fuel ratio of the exhaust gas which flows into the $NO_X$ storage reduction catalyst rich. To release the $SO_X$, fuel becomes necessary for the rise of temperature of the $NO_X$ storage reduction catalyst and the control of the air-fuel ratio.

In this way, for treatment to regenerate the $NO_X$ storage reduction catalyst, additional fuel is required. This was accompanied with a deterioration in the rate of consumption of fuel.

Solution to Problem

The present invention has as its object the provision of an exhaust purification system of an internal combustion engine which is provided with an $NO_X$ storage reduction catalyst and which suppresses the amount of fuel which is consumed at the time of treatment to regenerate the $NO_X$ storage reduction catalyst.

The exhaust purification system of an internal combustion engine of the present invention is provided with an $NO_X$ storage reduction catalyst which is arranged in an engine exhaust passage, which stores $NO_X$ which is contained in exhaust gas when an air-fuel ratio of the exhaust gas is lean, and when releases stored $NO_X$ when an air-fuel ratio of inflowing exhaust gas becomes a stoichiometric air-fuel ratio or rich and a trapping filter which is arranged at an upstream side of the $NO_X$ storage reduction catalyst and which traps particulate matter which is contained in the exhaust gas. When causing $NO_X$ or $SO_X$ which is stored in the $NO_X$ storage reduction catalyst to be released, the system raises the trapping filter to a temperature at which at least part of the particulate matter is oxidized, makes the flow rate of the exhaust gas which flows into the trapping filter drop, makes the air-fuel ratio of the exhaust gas fall so that the air-fuel ratio of the exhaust gas which flows out from the trapping filter becomes the stoichiometric air-fuel ratio or rich, and makes the particulate matter which builds up on the trapping filter oxidize to generate carbon monoxide as carbon monoxide production control to thereby supply the $NO_X$ storage reduction catalyst with carbon monoxide.

In the above invention, preferably the air-fuel ratio of the exhaust gas which flows into the trapping filter is made rich.

In the above invention, preferably the system is provided with an adjustment device which adjusts a ratio of the $NO_X$ and particulate matter present in the exhaust gas which is discharged from the engine body so that carbon monoxide which is produced from the particulate matter which builds up on the trapping filter and the $NO_X$ which builds up at the $NO_X$ storage reduction catalyst become a substantially stoichiometric mixture ratio.

In the above invention, preferably the system detects the amount of particulate matter which builds up on the trapping filter when the carbon monoxide production control ends and, when the amount of particulate matter is larger than a judgment value, raises the trapping filter to the temperature at which the particulate matter is oxidized to carbon dioxide or more and makes the air-fuel ratio of the exhaust gas which flows into the trapping filter lean to thereby make the particulate matter burn.

In the above invention, preferably the system is an exhaust purification system of an internal combustion engine which makes the $NO_X$ storage reduction catalyst rise to a temperature at which it can release $SO_X$ and performs carbon monoxide production control so as to make the catalyst release $SO_X$ as sulfur poisoning recovery treatment, wherein the system detects the $SO_X$ amount which is stored in the $NO_X$ storage reduction catalyst before the sulfur poisoning recovery treatment and makes the amount of particulate matter which is exhausted from the engine body increase or makes the amount of particulate matter which is burned decrease so that the amount of particulate matter which is required for the sulfur poisoning recovery treatment builds up at the trapping filter.

In the above invention, preferably the system is provided with a deterioration degree detection system which detects a degree of deterioration of the ability of the trapping filter to oxidize the particulate matter, uses the deterioration degree detection system to detect the degree of deterioration of the ability of the trapping filter to produce carbon monoxide, and makes the time of production of carbon monoxide longer the larger the degree of deterioration.

In the above invention, by making the opening degree of the valve of at least one of the throttle valve which is arranged in the engine intake passage and the exhaust throttle valve which is arranged in the engine exhaust passage smaller, it is possible to cause a drop in the flow rate of the exhaust gas which flows into the trapping filter.

Advantageous Effects of Invention

According to the present invention, it is possible to provide an exhaust purification system of an internal combustion engine which is provided with an $NO_X$ storage reduction catalyst and which suppresses the amount of fuel which is consumed at the time of treatment to regenerate the $NO_X$ storage reduction catalyst.

DESCRIPTION OF EMBODIMENTS

Embodiment 1

Referring to FIG. 1 to FIG. 15, an exhaust purification system of an internal combustion engine in Embodiment 1 will be explained.

Figure 1:
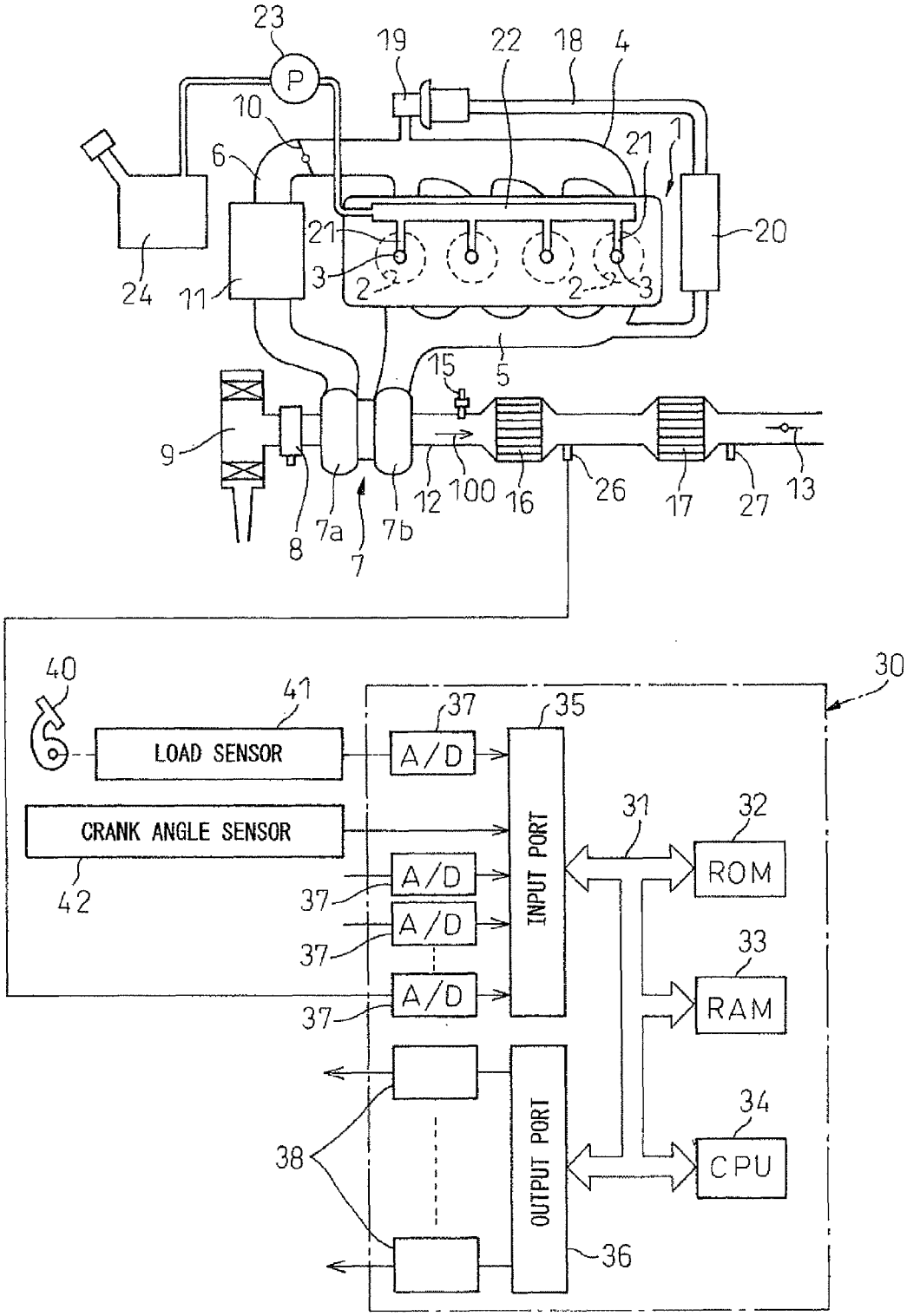
FIG. 1 is a schematic overall view of an internal combustion engine in Embodiment 1.

FIG. 1 is an overall view of an internal combustion engine in the present embodiment. In the present embodiment, the explanation will be given with reference to the example of a compression ignition type of diesel engine. The internal combustion engine is provided with an engine body 1. The engine body 1 includes a combustion chamber 2 of each cylinder, an electronic control type of fuel injector 3 for injecting fuel into each combustion chamber 2, an intake manifold 4, and an exhaust manifold 5.

The internal combustion engine in the present embodiment is provided with a supercharger comprised of an exhaust turbocharger 7. The intake manifold 4 is connected through an intake duct 6 to an outlet of a compressor 7*a* of an exhaust turbocharger 7. An inlet of the compressor 7*a* is connected through an intake air detector 8 to an air cleaner 9. Inside the intake duct 6 forming the engine intake passage, a throttle valve 10 which is driven by a step motor is arranged. Furthermore, at the intake duct 6, a cooling device 11 is arranged for cooling the intake air which flows through the inside of the intake duct 6. In the embodiment which is shown in FIG. 1, the engine cooling water is guided to the inside of the cooling device 11 where the engine cooling water is used to cool the intake air.

On the other hand, the exhaust manifold 5 is connected to an inlet of a turbine 7*b* of the exhaust turbocharger 7. The outlet of the exhaust turbine 7*b* is connected through an exhaust pipe 12 to a particulate filter (DPF) 16. Downstream of the particulate filter 16 inside the engine exhaust passage, an $NO_X$ storage reduction catalyst (NSR) 17 is arranged. Inside the engine exhaust passage, an exhaust throttle valve 13 is arranged. In the present embodiment, the exhaust throttle valve 13 is arranged downstream of the $NO_X$ storage reduction catalyst 17.

At the exhaust pipe 12 at the upstream side of the particulate filter 16, a fuel addition valve 15 is arranged as a fuel supply device for supplying unburned fuel to the inside of the exhaust pipe 12. The fuel addition valve 15 is formed so as to have a fuel supply action of supplying and stopping fuel. The exhaust purification system in the present embodiment is formed so that fuel of the engine body 1 is injected from the fuel addition valve 15. The fuel which is injected from the fuel addition valve 15 is not limited to this. The system may also be formed so as to inject fuel which is different from the fuel of the engine body 1. The exhaust gas, as shown by the arrow 100, flows toward the particulate filter 16.

Between the exhaust manifold 5 and the intake manifold 4, an exhaust gas recirculation (EGR) passage 18 is arranged for exhaust gas recirculation. In the EGR passage 18, an electronic control type of EGR control valve 19 is arranged. Further, in the EGR passage 18, a cooling device 20 is arranged for cooling the EGR gas which flows through the inside of the EGR passage 18. In the embodiment which is shown in FIG. 1, the engine cooling water is guided to the cooling device 20 and the engine cooling water is used to cool the EGR gas.

These fuel injectors 3 are connected through fuel feed tubes 21 to a common rail 22. This common rail 22 is connected through an electronic control type of variable discharge fuel pump 23 to a fuel tank 24. The fuel which is stored in the fuel tank 24 is supplied by the fuel pump 23 to the inside of the common rail 22. The fuel which is supplied to the common rail 22 is supplied through fuel feed tubes 21 to the fuel injectors 3.

The electronic control unit 30 is comprised of a digital computer. The control device of the internal combustion engine in the present embodiment includes an electronic control unit 30. The electronic control unit 30 is provided with components which are connected to each other by a bidirectional bus 31 such as a ROM (read only memory) 32, RAM (random access memory) 33, CPU (microprocessor) 34, input port 35, and output port 36. The ROM 32 is a storage device for read only operations and stores maps and other information necessary for control in advance. The CPU 34 can perform any processing or judgment. The RAM 33 is a storage device for random access operations and can store operational history and other information or temporarily store processing results.

In the engine exhaust passage downstream of the particulate filter 16, a temperature sensor 26 for detecting the temperature of the particulate filter 16 is arranged. Further, downstream of the $NO_X$ storage reduction catalyst 17, a temperature sensor 27 for detecting the temperature of the $NO_X$ storage reduction catalyst 17 is arranged. The output signals of the temperature sensors 26 and 27 are input through the corresponding AD converters 37 to the input port 35.

An accelerator pedal 40 is connected to a load sensor 41 which generates an output voltage which is proportional to an amount of depression of the accelerator pedal 40. The output signal of the load sensor 41 is input through a corresponding AD converter 37 to the input port 35. Further, the input port 35 has a crank angle sensor 42 connected to it which generates an output pulse every time a crank shaft rotates by for example 15°. From the output of the crank angle sensor 42, it is possible to detect the speed of the engine body 1.

On the other hand, the output port 36 is connected through corresponding drive circuits 38 to the fuel injectors 3, the step motor for driving the throttle valve 10, the EGR control valve 19, and the fuel pump 23. Further, the output port 36 is connected through a corresponding drive circuit 38 to the fuel addition valve 15. These devices are controlled by the electronic control unit 30.

Figure 2:
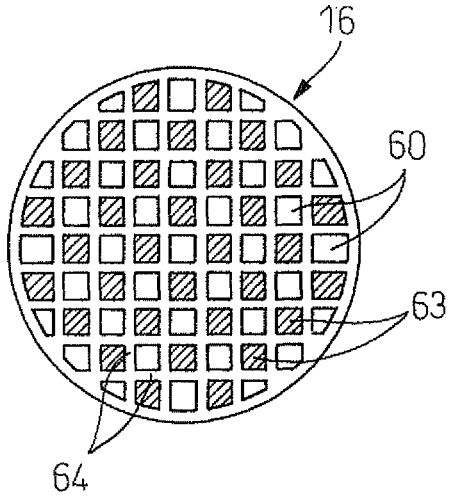
FIG. 2 is a schematic front view of a particulate filter.
Figure 3:
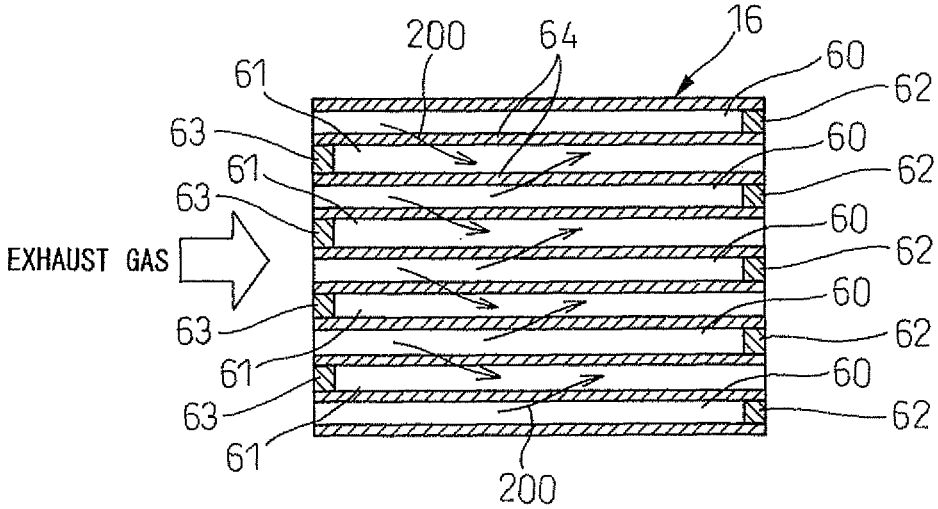
FIG. 3 is a schematic cross-sectional view of a particulate filter.

FIG. 2 is a schematic front view of a particulate filter. FIG. 3 is a schematic cross-sectional view of the particulate filter when cut along the axial direction. The trapping filter comprised of the particulate filter 16 is a filter for removing the carbon microparticles, sulfates, and other particulate matter (PM) which are contained in the exhaust gas. The particulate filter 16 in the present embodiment is formed to a cylindrical shape.

The particulate filter 16 in the present embodiment has a honeycomb structure. The particulate filter 16 has a plurality of passages 60 and 61 which extend along the direction of flow of the exhaust gas. The passages 60 are closed at their bottom ends by plugs 62. The passages 61 are closed at their upstream ends by plugs 63. The passages 60 and passages 61 are arranged alternately through thin partition walls 64. In FIG. 2, the parts of the plugs 63 are shown by hatching.

The particulate filter 16 is, for example, formed from a porous material such as cordierite. The passages 60 into which the exhaust gas flows are surrounded by passages 61 out of which exhaust gas flows. The exhaust gas which flows into the passages 60, as shown by the arrow 200, pass through the surrounding partition walls 64 to flow out to the adjoining passages 61. When the exhaust gas passes through the partition walls 64, the particulate matter is trapped. The exhaust gas passes through the passages 61 and flows out from the particulate filter 16. The particulate matter is trapped in the particulate filter in this way.

Figure 4:
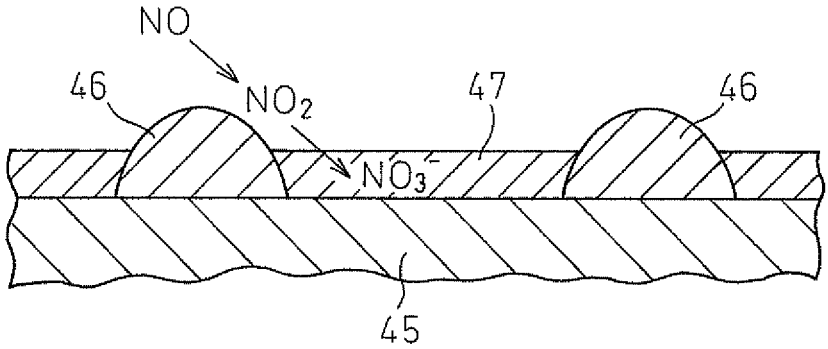
FIG. 4 is an enlarged schematic cross-sectional view of an $NO_X$ storage reduction catalyst.

FIG. 4 is an enlarged schematic cross-sectional view of an $NO_X$ storage reduction catalyst. The $NO_X$ storage reduction catalyst 17 is a catalyst which temporarily stores the $NO_X$ which is contained in the exhaust gas which is exhausted from the engine body 1 and converts it to $N_2$ when releasing stored $NO_X$.

The $NO_X$ storage reduction catalyst 17 is comprised of a base material on which a catalyst carrier 45 comprised of for example alumina is carried. On the surface of the catalyst carrier 45, a precious metal catalyst 46 is carried in a dispersed manner. On the surface of the catalyst carrier 45, a layer of the $NO_X$ absorbent 47 is formed. As the precious metal catalyst 46, for example, platinum Pt is used. As the component forming the $NO_X$ absorbent 47, for example, at least one element selected from potassium K, sodium Na, cesium Cs, and other such alkali metals, barium Ba, calcium Ca, and other such alkali earths, and lanthanum La, yttrium Y, and other such rare earths is used.

If referring to the ratio of the air and fuel (hydrocarbons) which are supplied to the engine intake passage, combustion chambers, or the engine exhaust passage as "the air-fuel ratio of the exhaust gas (A/F)", when the air-fuel ratio of the exhaust gas is lean (when larger than the stoichiometric air-fuel ratio), the NO which is contained in the exhaust gas is oxidized on the precious metal catalyst 46 and becomes $NO_2$. $NO_2$ is stored in the form of nitric acid ions $NO_3^-$ in the $NO_X$ absorbent 47.

As opposed to this, when the air-fuel ratio of the exhaust gas becomes rich (when smaller than the stoichiometric air-fuel ratio) or the stoichiometric air-fuel ratio, the oxygen concentration in the exhaust gas falls, so the reaction proceeds in the opposite direction ($NO_3^- \rightarrow NO_2$). The nitric acid ions $NO_3^-$ inside the $NO_X$ absorbent 47 are released in the form of $NO_2$ from the $NO_X$ absorbent 47. The released $NO_X$ is reduced to $N_2$ by the unburned hydrocarbons and carbon monoxide which are contained in the exhaust gas.

Figure 5:
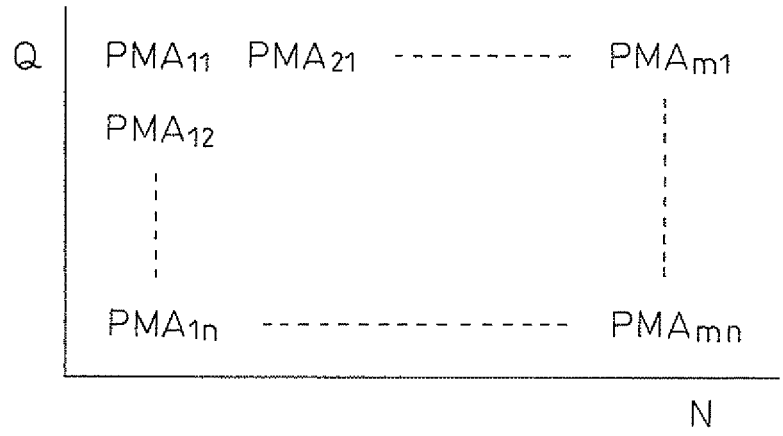
FIG. 5 is a map of an amount of particulate matter which builds up on a particulate filter per unit time.

FIG. 5 is a map which calculates the particulate matter amount which builds up on the particulate filter. The particulate matter amount PMA which builds up on the particulate filter per unit time is found from the engine speed N and the fuel injection amount Q in the combustion chambers. By cumulatively adding the particulate matter amounts PMA which build up per unit time as found from this map, it is possible to estimate the amount of buildup of particulate matter at any timing. Referring to FIG. 1, such a map is for example stored in advance in the ROM 32 of the electronic control unit 30. The calculated amounts of buildup of particulate matter may for example be stored in the RAM 33.

In the present embodiment, the map of the amount of particulate matter which builds up per unit time is used to calculate the amount of buildup of particulate matter, but the invention is not limited to this. Any method may be used to calculate the amount of buildup of particulate matter. For example, it is also possible to arrange a differential pressure sensor to detect the differential pressure before and after the particulate filter. The output of the differential pressure sensor may be used to estimate the amount of buildup of particulate matter.

Figure 6:
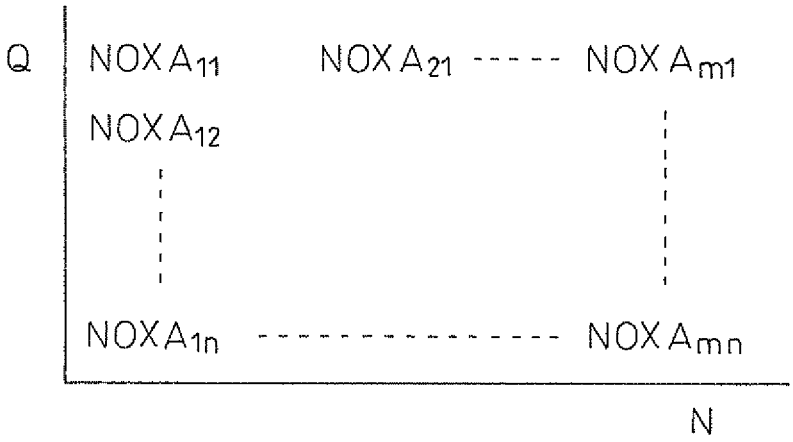
FIG. 6 is a map of the amount of $NO_X$ which is stored in the $NO_X$ storage reduction catalyst per unit time.

FIG. 6 shows a map of the amount of $NO_X$ which is stored in the $NO_X$ storage reduction catalyst per unit time in the present embodiment. In the present embodiment, the $NO_X$ storage amount of $NO_X$ which is stored in the $NO_X$ storage reduction catalyst is estimated. For example, a map of the $NO_X$ amount NOXA per unit time having the engine speed N and the fuel injection amount Q as functions is built into the ROM 32 of the electronic control unit 30. By cumulatively adding the $NO_X$ storage amount per unit time which is calculated in accordance with the operating state, the $NO_X$ storage amount at any time may be calculated.

Figure 7:
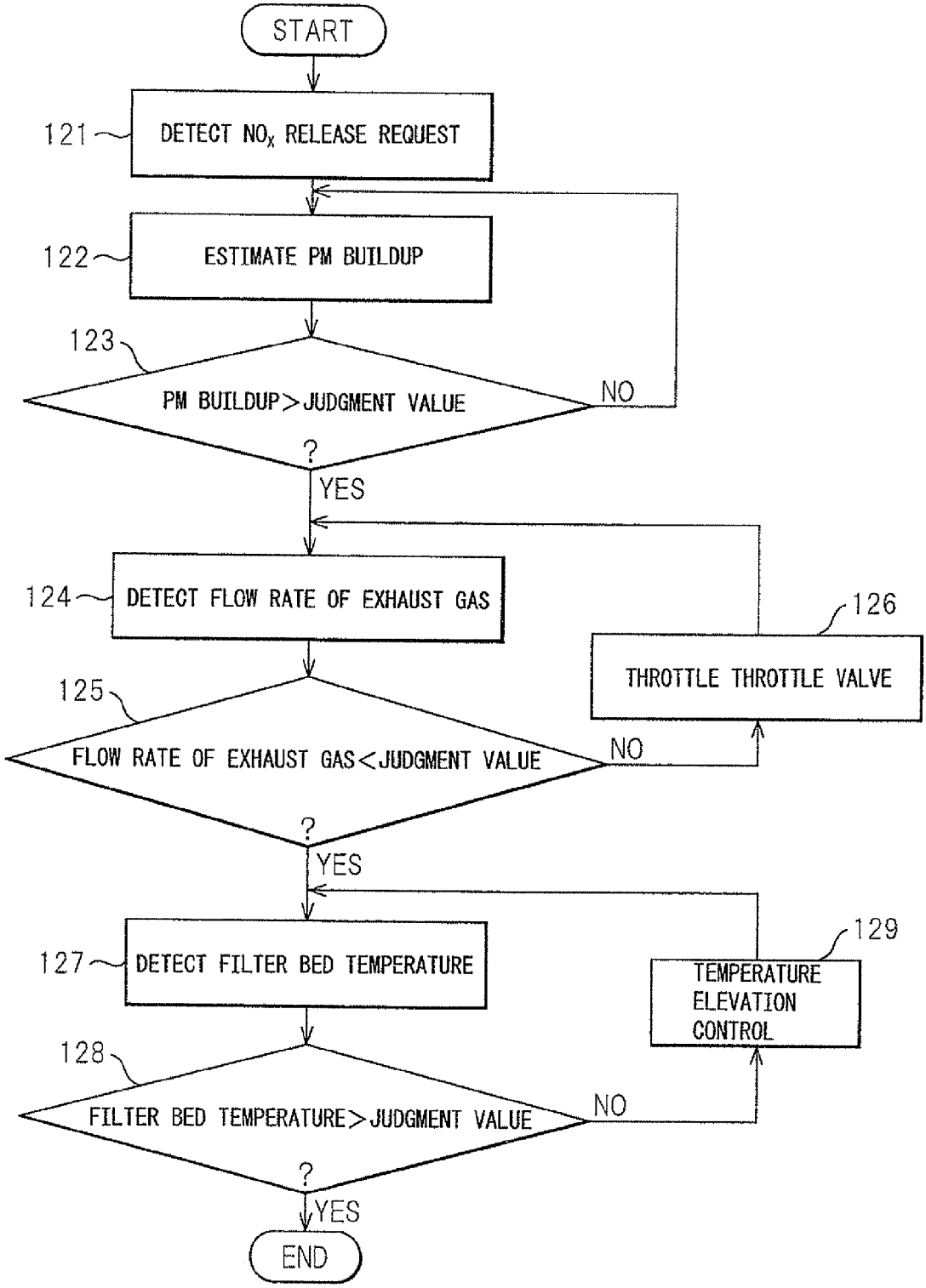
FIG. 7 is a flow chart of a first operational control in Embodiment 1.

FIG. 7 shows a flow chart of a first operational control in the present embodiment. The first operational control is control for when causing the $NO_X$ storage reduction catalyst to release $NO_X$. The $NO_X$ storage reduction catalyst gradually has $NO_X$ built up at it if continuously used. In the present embodiment, when the $NO_X$ storage amount reaches a predetermined allowable value, control is performed to make $NO_X$ be released.

The exhaust purification system of the present embodiment performs carbon monoxide production control which produces carbon monoxide from the particulate matter which builds up on the particulate filter when causing the $NO_X$ storage reduction catalyst to release $NO_X$ or $SO_X$. Carbon monoxide is a suitable reducing agent. The produced carbon monoxide is fed to the $NO_X$ storage reduction catalyst to treat it to regenerate.

At step 121, the $NO_X$ storage amount of the $NO_X$ storage reduction catalyst reaches the allowable value and an $NO_X$ release request is detected.

Next, at step 122, the amount of particulate matter which builds up on the particulate filter (PM buildup) is detected. At step 123, it is judged if an amount of particulate matter necessary for release of $NO_X$ is building up on the particulate filter. At step 123, it is judged if the PM buildup is larger than a judgment value of PM buildup. For the judgment value of PM buildup, for example, a predetermined judgment value can be used.

When, at step 123, the PM buildup is the judgment value or less, the routine returns to step 122. Alternatively, when the PM buildup is the judgment value or less, control may be performed to make the particulate matter which is exhausted from the engine body increase. When, at step 123, the PM buildup is larger than the judgment value, the routine proceeds to step 124.

The particulate matter becomes carbon monoxide due to the occurrence of the oxidation reaction. Furthermore, the oxidation reaction progresses and the matter becomes carbon dioxide. The oxidation reaction of the particulate matter which builds up on the particulate filter depends on the temperature of the particulate filter. For example, it depends on the bed temperature of the particulate filter. The higher the temperature of the particulate filter, the more the oxidation reaction progresses. Further, the oxidation reaction of the particulate matter depends on the flow rate of the exhaust gas (or spatial velocity). If the flow rate of the exhaust gas is large and the amount of oxygen which is contained in the exhaust gas is great, the oxidation reaction progresses.

When causing $NO_X$ to be released, it is preferable that a large amount of carbon monoxide be produced within the operating region where the particulate matter reacts with the oxygen. That is, preferably the oxidation reaction does not progress and particulate matter is not converted up to carbon dioxide. In the present embodiment, the flow rate of intake air which flows into the combustion chambers is made smaller. The flow rate of the oxygen which is contained in the exhaust gas becomes smaller. Furthermore, the temperature of the particulate filter is made to rise so that an oxidation reaction of the particulate matter occurs and carbon monoxide is produced.

At step 124, the flow rate of the exhaust gas which flows into the particulate filter is estimated. Referring to FIG. 1, for example, by detecting the flow rate of intake air by the intake air detector 8 and using the injection amount of fuel at the combustion chambers 2 as the basis to correct the flow rate of intake air, the flow rate of the exhaust gas can be estimated. Instead of the flow rate of the exhaust gas, it is also possible to estimate the spatial velocity (SV) of the exhaust gas.

Next, at step 125, it is judged if the estimated flow rate of the exhaust gas is smaller than a judgment value of the flow rate of the exhaust gas.

Figure 8:
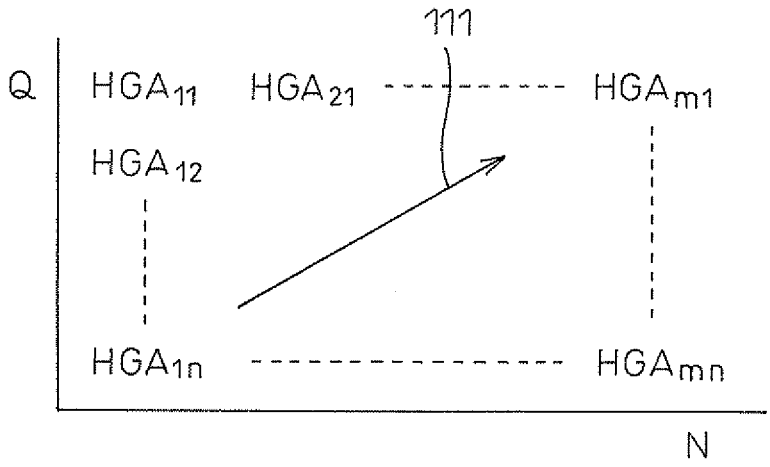
FIG. 8 is a map of a judgment value of a flow rate of exhaust gas in the first operational control of Embodiment 1.

FIG. 8 shows a map of a judgment value HGA of the flow rate of the exhaust gas in the present embodiment. Carbon monoxide is produced even if the temperature is low if, for example, the flow rate of the exhaust gas is small. The judgment value of the flow rate of the exhaust gas can be determined as a function of the engine speed N and the fuel injection amount Q in the combustion chambers. As shown by the arrow 111, the larger the engine speed N and, further, the larger the fuel injection amount, the larger the judgment value HGA becomes. In the present embodiment, the map of the judgment value having the temperature of the particulate filter and the flow rate of the exhaust gas as functions is converted to form a map of the judgment value having the engine speed N and fuel injection amount Q as functions.

Referring to FIG. 7, when, at step 125, the flow rate of the exhaust gas is the judgment value or more, the routine proceeds to step 126. At step 126, referring to FIG. 1, the throttle valve 10 is throttled so as to make the flow rate of the air which flows into the engine body 1 decrease. The flow rate of the exhaust gas which is discharged from the engine body 1 is decreased. Steps 124 and 126 are repeated to repeat this control until the flow rate of the exhaust gas becomes less than the judgment value. Further, by throttling the throttle valve 10, the air-fuel ratio of the exhaust gas which flows into the particulate filter falls. In the present embodiment, the throttle valve 10 is throttled until the air-fuel ratio of the exhaust gas which flows into the particulate filter becomes rich.

When, at step 125, the flow rate of the exhaust gas which flows into the particulate filter is smaller than the judgment value, the routine proceeds to step 127. At step 127, the bed temperature of the particulate filter is detected. Referring to FIG. 1, the bed temperature of the particulate filter 16 can be detected by the output of the temperature sensor 26.

Next, at step 128, it is judged if the bed temperature of the particulate filter is larger than a judgment value of the bed temperature. For this judgment value, the target temperature at the time of production of carbon monoxide can be employed. When, at step 128, the bed temperature of the particulate filter is the judgment value or less, the routine proceeds to step 129.

At step 129, temperature elevation control is performed to make the temperature of the particulate filter 16 rise. In the present embodiment, referring to FIG. 1, unburned fuel is fed from the fuel addition valve 15. The particulate filter in the present embodiment carries a metal catalyst for promoting the oxidation reaction. The metal catalyst, for example, includes precious metal particles. The unburned fuel is oxidized on the surface of the metal catalyst whereby heat of oxidation reaction is generated. Due to this heat of oxidation reaction, the particulate filter 16 can be raised in temperature.

When, at step 128, the bed temperature of the particulate filter is larger than the judgment value, the particulate matter is oxidized and carbon monoxide is produced. The air-fuel ratio of the exhaust gas which flows out from the particulate filter is rich. Exhaust gas including carbon monoxide flows into the $NO_X$ storage reduction catalyst whereby $NO_X$ of the $NO_X$ storage reduction catalyst is released. In the $NO_X$ storage reduction catalyst, the released $NO_X$ is reduced to $N_2$. The carbon monoxide production control is continued until a predetermined amount of $NO_X$ is released from the $NO_X$ storage reduction catalyst.

In the example of control which is shown in FIG. 7, the flow rate of the exhaust gas which flows into the particulate filter adjusted, then the bed temperature of the particulate filter is adjusted, but the invention is not limited to this. Either may be performed first. Alternatively, both may be performed simultaneously.

Figure 9:
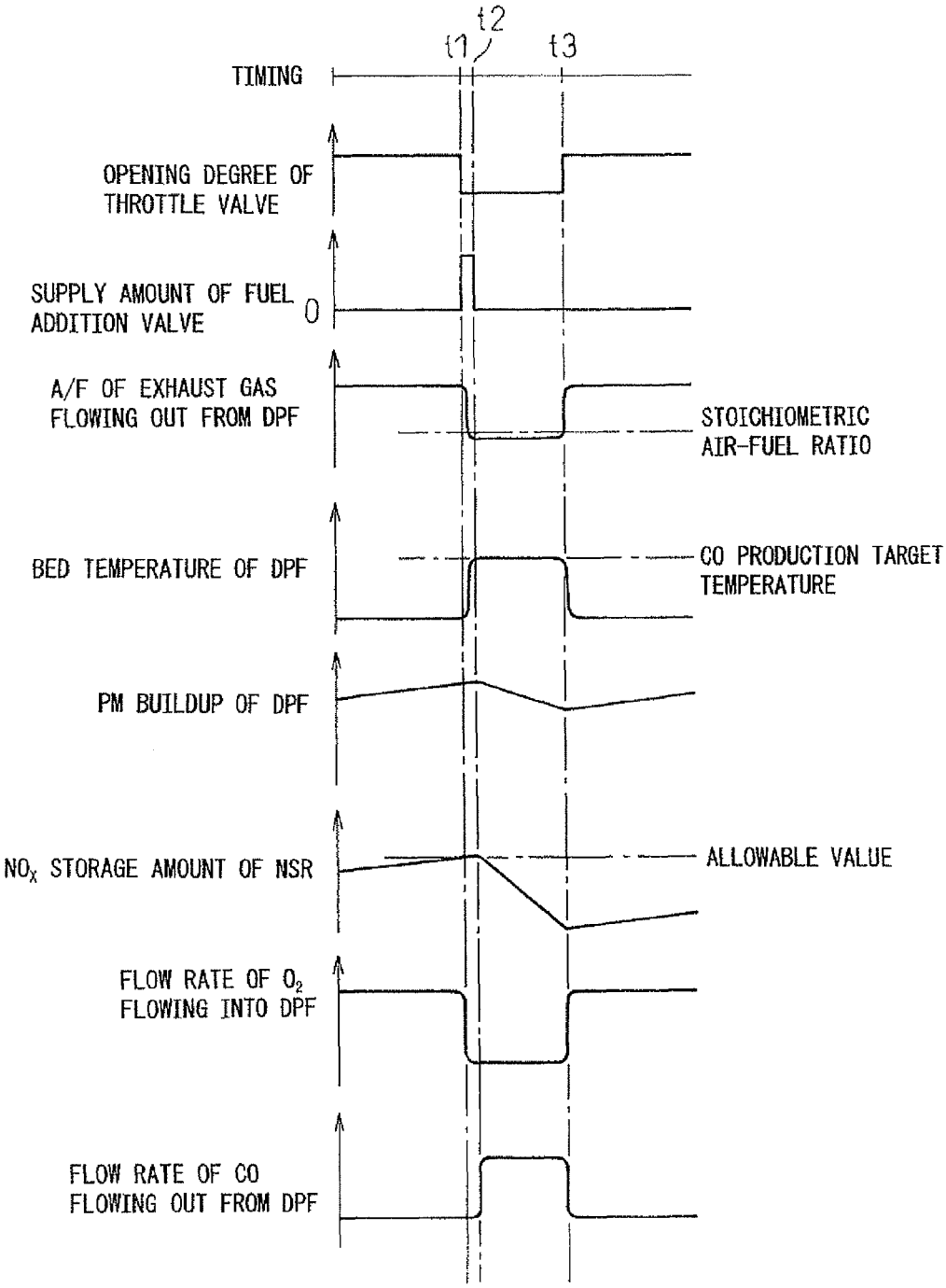
FIG. 9 is a time chart of the first operational control in Embodiment 1.

FIG. 9 shows a time chart of the first operational control in the present embodiment. Up until the time t1, normal operation is performed. At the time t1, the $NO_X$ storage amount of the $NO_X$ storage reduction catalyst reaches the allowable value. The allowable value of the $NO_X$ storage reduction catalyst is preferably set smaller, with a safety margin, than a saturation amount at which the $NO_X$ storage reduction catalyst becomes saturated by $NO_X$. Alternatively, to prevent the allowable value of the $NO_X$ storage amount from being exceeded, it is possible to employ a judgment value which is smaller than this allowable value for the value for starting the release of $NO_X$.

At the time t1, a request signal is issued for release of $NO_X$. The amount of buildup of particulate matter at the particulate filter is continuously detected. At the time t1, the opening degree of the throttle valve is made to be reduced so that the flow rate of the exhaust gas which flows into the particulate filter becomes less than judgment value. Further, from the time t1, temperature elevation control for making the temperature of the particulate filter rise is performed.

By feeding unburned fuel from the fuel addition valve 15, the particulate filter can be raised to the temperature which is higher than target temperature of production of carbon monoxide. At the time t2, the bed temperature of the particulate filter reaches the target temperature of production of carbon monoxide. In the example of control which is shown in FIG. 9, at the time t2, the air-fuel ratio of the exhaust gas which flows into the particulate filter becomes rich.

At the time t2 to the time t3, the temperature of the particulate filter is maintained at the temperature at which the particulate matter can be burned or higher. The opening degree of the throttle valve is small and the flow rate of oxygen which flows into the particulate filter becomes small. The air-fuel ratio of the exhaust gas which flows into the particulate filter becomes rich and a state of insufficient oxygen is formed. The oxidation reaction of the particulate matter does not progress and carbon monoxide is produced. That is, the production of carbon dioxide is suppressed and the production of carbon monoxide is promoted.

By the particulate matter burning and carbon monoxide being produced, the amount of buildup of particulate matter of the particulate filter is reduced. Carbon monoxide flows into the $NO_X$ storage reduction catalyst. The stored $NO_X$ is released and the $NO_X$ storage amount is reduced. In the time period from the time t2 to the time t3, the temperature of the particulate filter descends. If becoming less than the target temperature for production of carbon monoxide, the fuel addition valve may feed fuel and the particulate filter may be raised in temperature.

The release of $NO_X$ continues until a predetermined amount of $NO_X$ is released. In the present embodiment, it is possible to calculate the necessary amount of carbon monoxide from the amount of $NO_X$ to be made to be released. It is possible to estimate the amount of oxygen which is contained in the exhaust gas which flows into the particulate filter, the PM buildup, and the bed temperature of the particulate filter and use these variables as the basis to estimate the amount of carbon monoxide which flows out from the particulate filter per unit time. By cumulatively adding the amount of carbon monoxide per unit time, it is possible to calculate the amount of supply of carbon monoxide at any timing. The release of $NO_X$ is ended when the amount of supply of carbon monoxide reaches the amount which is required for release of $NO_X$. The time period for release of $NO_X$ is not limited to this. For example, it may also be performed at a predetermined time period.

From the time t3 on, the release of $NO_X$ is ended and normal operation is reset.

The carbon monoxide production control in the first operational control of the present embodiment raises the trapping filter to a temperature able to oxidize at least part of the particulate matter. The flow rate of the exhaust gas which flows into the trapping filter is lowered. Furthermore, this includes control for making the air-fuel ratio of the exhaust gas which flows out from the trapping filter rich.

The exhaust purification system of an internal combustion engine of the present embodiment supplies the $NO_X$ storage reduction catalyst with a reducing agent comprised of carbon monoxide at the time of release of $NO_X$ of the $NO_X$ storage reduction catalyst. Carbon monoxide is a highly reactive reducing agent. For example, its reducing ability is higher than diesel oil and other fuel. For this reason, it is possible to suitably perform the release of $NO_X$ from the $NO_X$ storage reduction catalyst.

Further, in the present embodiment, at the particulate filter, the oxidation reaction of the particulate matter makes the oxygen which is contained in the exhaust gas be consumed. For this reason, low oxygen concentration exhaust gas can be supplied to the $NO_X$ storage reduction catalyst. The oxygen causing a drop in the reduction reaction is eliminated, so high reactivity reduction can be performed in the $NO_X$ storage reduction catalyst.

The exhaust purification system of an internal combustion engine in the present embodiment can perform high reactivity reduction at the $NO_X$ storage reduction catalyst, so the amount of consumption of fuel for causing release of $NO_X$ can be suppressed. Furthermore, the exhaust purification system in the present embodiment can release $NO_X$ at the time of various operating states. $NO_X$ can be released in accordance with operating states which change along with time.

Further, at the same time as regeneration of the $NO_X$ storage reduction catalyst, part of the particulate matter can be burned off. Part of the particulate matter which builds up at the particulate filter can therefore be removed. For this reason, when regeneration of the particulate filter is performed separately, the amount of particulate matter which should be removed at the time of regeneration can be reduced. For this reason, the consumption of fuel at regeneration of the particulate filter can be suppressed.

In the present embodiment, control is performed so that the air-fuel ratio of the exhaust gas which flows into the particulate filter becomes rich, but the invention is not limited to this. Control may be performed so that the air-fuel ratio of the exhaust gas which flows into the particulate filter becomes the stoichiometric air-fuel ratio or slightly leaner than the stoichiometric air-fuel ratio. At this time, the bed temperature of the particulate filter is preferably controlled to a temperature range where carbon monoxide is produced from the built-up particulate matter. Inside the particulate filter, oxygen is consumed for oxidation of the particulate matter, so the air-fuel ratio of the exhaust gas which flows out from the particulate filter can be made the stoichiometric air-fuel ratio or rich. Control can be performed so that the air-fuel ratio of the exhaust gas which flows into the $NO_X$ storage reduction catalyst becomes the stoichiometric air-fuel ratio or rich.

In the first operational control of the present embodiment, the opening degree of the throttle valve is reduced to cause a drop in the flow rate of the exhaust gas which flows into the particulate filter, but the invention is not limited to this. It is possible to use any device to cause a drop in the flow rate of the exhaust gas which flows into the particulate filter. For example, as shown in FIG. 1, an exhaust throttle valve 13 may be arranged in the engine exhaust passage and the opening degree of the exhaust throttle valve 13 made smaller. The exhaust throttle valve 13 may be used to make the flow sectional area smaller and cause a drop in the flow rate of the exhaust gas which flows into the particulate filter. Alternatively, the opening degrees of both the throttle valve 10 and the exhaust throttle valve 13 may be made smaller.

In the present embodiment, the opening degree of the throttle valve is made smaller to cause a drop in the air-fuel ratio of the exhaust gas, but the invention is not limited to this. In addition to changing the opening degree of the throttle valve, the combustion pattern in the combustion chambers may be changed to cause a drop in the air-fuel ratio of the exhaust gas.

For example, fuel may be injected by auxiliary injection in the combustion chambers in a period where combustion is possible after the main injection so as to cause a drop in the air-fuel ratio of the exhaust gas. At least part of the fuel of the auxiliary injection can be made to burn in the combustion chambers to cause a drop in the air-fuel ratio of the exhaust gas. By this control, the nitrogen dioxide $NO_2$ which is contained in the exhaust gas increases. Nitrogen dioxide $NO_2$ has a strong oxidizing power and is good for oxidation of particulate matter. For this reason, the bed temperature of the particulate filter when producing carbon monoxide can be lowered.

In the present embodiment, the flow rate of air which flows into the combustion chambers is reduced to cause a drop in the air-fuel ratio of the exhaust gas which flows into the particulate filter, but the invention is not limited to this. Supply of fuel from a fuel addition valve may also be made joint use of.

Figure 10:
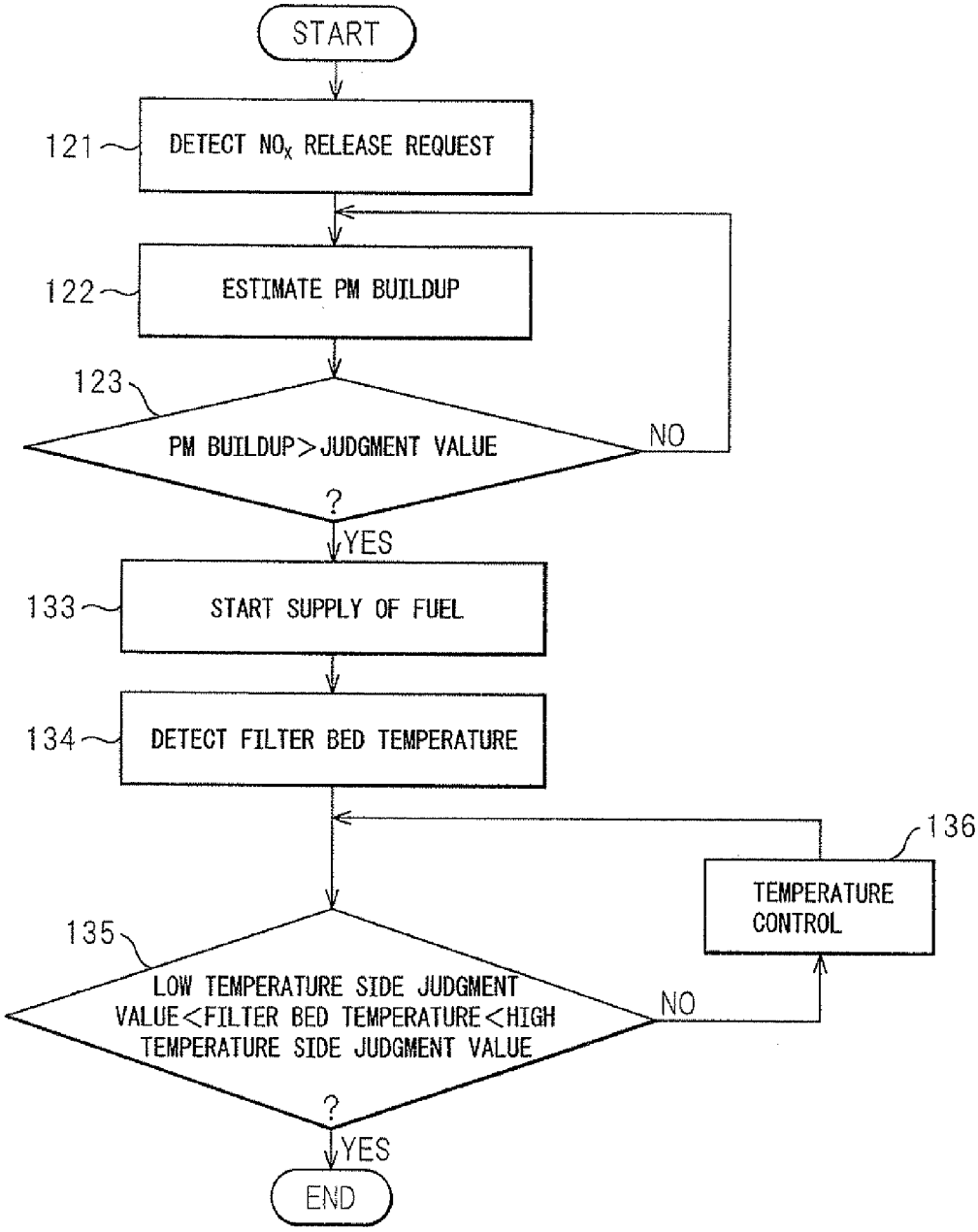
FIG. 10 is a flow chart of a second operational control in Embodiment 1.

FIG. 10 is a flow chart of a second operational control in the present embodiment. The second operational control is control when making the $NO_X$ storage reduction catalyst release $NO_X$ and includes carbon monoxide production control. In the second operational control, the bed temperature of the particulate filter is controlled to within the temperature range where carbon monoxide is produced. The higher the bed temperature of the particulate filter, the more the oxidation reaction progresses and carbon dioxide is oxidized to. In the second operational control, the temperature of the particulate filter is controlled so that when the particulate matter becomes carbon monoxide, the oxidation reaction is suppressed.

Step 121 to step 123 is similar to the first operational control in the present embodiment. At step 123, when the PM buildup at the particulate filter is larger than the judgment value, the routine proceeds to step 133.

At step 133, addition of fuel by the fuel addition valve is started. The rise in temperature of the particulate filter is started. At step 134, the bed temperature of the particulate filter is detected. When addition of fuel by the fuel addition valve has been started, the air-fuel ratio of the exhaust gas which flows into the particulate filter is lean.

At step 135, it is judged if the bed temperature of the particulate filter is larger than a low temperature side judgment value and smaller than a high temperature side judgment value. In the second operational control, the bed temperature of the particulate filter is controlled to within a temperature range where a large amount of carbon monoxide is produced. For example, the bed temperature of the particulate filter can be set to a temperature range somewhat higher than the temperature at which carbon monoxide starts to be produced.

Figure 11:
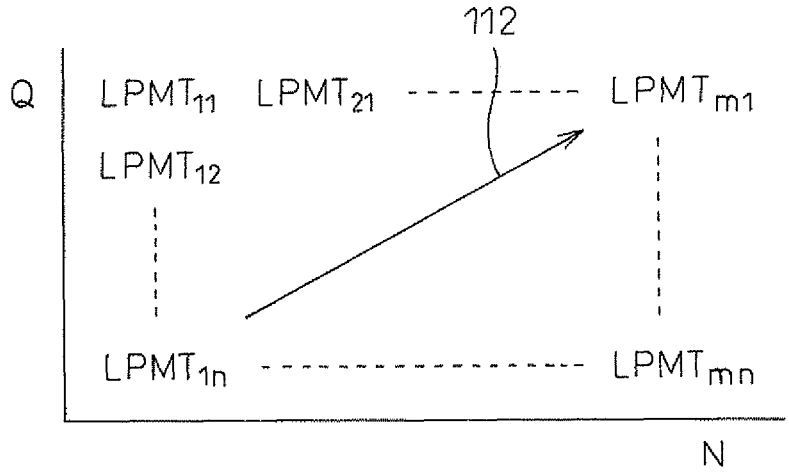
FIG. 11 is a map of a low temperature side judgment value of a bed temperature of a particulate filter of the second operational control of Embodiment 1.

FIG. 11 shows a map of the low temperature side judgment value of the bed temperature of the particulate filter. The low temperature side judgment value LPMT can be determined as a function of the engine speed N and the fuel injection amount Q in the combustion chambers. As shown by the arrow mark 112, the larger the engine speed and, further, the larger the fuel injection amount, the larger the judgment value becomes. The high temperature side judgment value HPMT of the bed temperature of the particulate filter, like the low temperature side judgment value HPMT, can be determined from the map as a function of the engine speed N and fuel injection amount Q.

Referring to FIG. 10, when, at step 135, the bed temperature of the particulate filter is the low temperature side judgment value or less or the high temperature side judgment value or more, the routine proceeds to step 136. At step 136, temperature control is performed to adjust the temperature of the particulate filter. In the present embodiment, the feed of unburned fuel from the fuel addition valve 15 is adjusted to control the temperature of the particulate filter 16. When the bed temperature of the particulate filter is a low temperature side judgment value or less, control is performed to cause an increase in the feed of fuel from the fuel addition valve 15. When the bed temperature of the particulate filter is a high temperature side judgment value or more, control is performed to cause a reduction in the feed of fuel from the fuel addition valve 15. The amount of addition of fuel from the fuel addition valve is adjusted so that the bed temperature of the particulate filter becomes larger than the low temperature side judgment value and smaller than the high temperature side judgment value. By making the bed temperature of the particulate filter a predetermined temperature range in this way, carbon monoxide can be produced.

The second operational control can cause a drop in the combustion rate and cause the production of carbon monoxide when the particulate matter of the particulate filter is burning. The exhaust gas which flows out from the particulate filter contains carbon monoxide. If exhaust gas which contains carbon monoxide flows into the $NO_X$ storage reduction catalyst, in the $NO_X$ storage reduction catalyst, the carbon monoxide and the oxygen which is contained in the exhaust gas react whereby the oxygen is consumed. The air-fuel ratio of the exhaust gas falls and $NO_X$ can be released from the $NO_X$ storage reduction catalyst. Furthermore, the excess carbon monoxide can be used to reduce the $NO_X$. In the second operational control as well, operation to produce carbon monoxide is continued until a predetermined amount of $NO_X$ is released.

Figure 12:
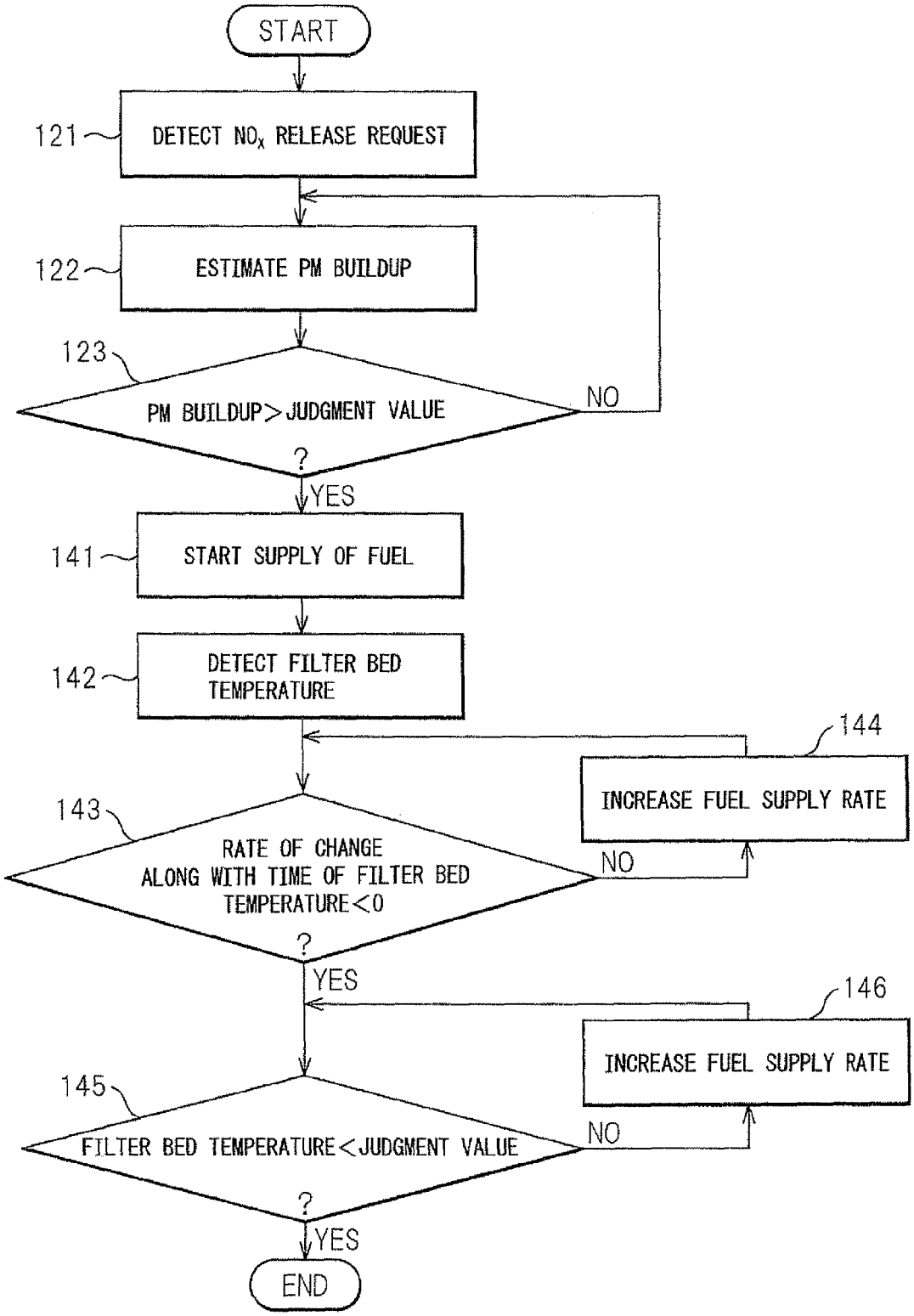
FIG. 12 is a flow chart of a third operational control in Embodiment 1.

FIG. 12 shows a flow chart of a third operational control in the present embodiment. The third operational control is control for making the $NO_X$ storage reduction catalyst release $NO_X$ and includes carbon monoxide production control. In the third operational control, in the state where the particulate matter is burning, an fire extinguishing agent is supplied to the engine exhaust passage to thereby form a state of insufficient oxygen. In the present embodiment, fuel is supplied as the fire extinguishing agent. Further, the bed temperature of the particulate filter is made a temperature range in which carbon monoxide is produced to thereby promote the production of carbon monoxide.

Step 121 to step 123 are similar to the first operational control in the present embodiment. When, at step 123, the PM buildup is larger than a judgment value, the routine proceeds to step 141. At step 141, the feed of fuel from the fuel addition valve is started to raise the temperature of the particulate filter. At step 142, the bed temperature of the particulate filter is detected. At step 143, it is detected if the rate of change over time of the bed temperature of the particulate filter is negative or not.

When, at step 143, the rate of change over time of the bed temperature of the particulate filter is zero or more, the routine proceeds to step 144. At step 144, the feed of fuel is made to increase. In this way, the feed of fuel is made to increase until completely consuming the oxygen which is contained in the exhaust gas.

By increasing the feed of fuel from the fuel addition valve, the oxidation reaction of the unburned fuel at the particulate filter is promoted and the temperature rises. Further, when the temperature able to burn the particulate matter is reached, the oxidation reaction of the particulate matter is started. If further increasing the feed of fuel, the oxygen which is contained in the exhaust gas is completely consumed by the oxidation of the unburned fuel. If further increasing the feed of fuel, the fuel which is fed becomes a heat absorbing material without engaging in an oxidation reaction. For this reason, the bed temperature of the particulate filter falls along with an increase of the feed of fuel. If repeating the increase in the amount of addition of fuel in this way, the rate of change over time of the bed temperature changes from positive to negative.

When, at step 143, the rate of change over time of the bed temperature of the particulate filter is negative, that is, when the bed temperature of the particulate filter falls along with the elapse of time, the routine proceeds to step 145.

At step 145, it is judged if the bed temperature of the particulate filter is less than the judgment value when producing carbon monoxide. When the bed temperature of the particulate filter is the judgment value or more, the routine proceeds to step 146. At step 146, the fuel feed is increased further. By increasing the fuel feed, the bed temperature of the particulate filter falls.

When, at step 145, the bed temperature of the particulate filter is less than the judgment value when producing carbon monoxide, the operating state is maintained. At this time, the air-fuel ratio of the exhaust gas which flows into the particulate filter is rich in state. Further, the oxygen is insufficient in state, so the oxidation reaction of the particulate matter is suppressed and carbon monoxide is produced. The carbon monoxide is supplied to the $NO_X$ storage reduction catalyst, whereby $NO_X$ is released from the $NO_X$ storage reduction catalyst.

In the third operational control in the present embodiment, fuel is supplied more than so that the unburned fuel actively burns. Due to the oxidation of the unburned fuel, the concentration of the oxygen which is contained in the exhaust gas can be reduced. In the particulate filter, carbon monoxide can be produced from the particulate matter. Further, the bed temperature of the particulate filter may be made to drop so as to promote the production of carbon monoxide.

In the present embodiment, as the fuel supply device which supplies unburned fuel to the engine exhaust passage, a fuel addition valve is arranged, but the invention is not limited to this. For the fuel supply device, any device which can supply the engine exhaust passage with unburned fuel may be employed. For example, it is possible to change the injection pattern of the fuel in the combustion chambers to supply the engine exhaust passage with unburned fuel.

Figure 13:
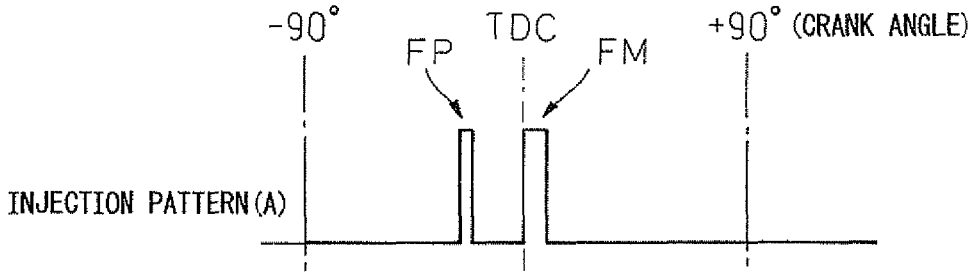
FIG. 13 is an explanatory view of an injection pattern at a time of normal operation.

FIG. 13 shows the injection pattern of fuel at the time of normal operation in the internal combustion engine in the present embodiment. The injection pattern A is the injection pattern of fuel at the time of normal operation. At the time of normal operation, main injection FM is performed at about compression top dead center TDC. The main injection FM is performed at a crank angle of about 0°. Further, to make the combustion of the main injection FM stable, pilot injection FP is performed before the main injection FM.

Figure 14:
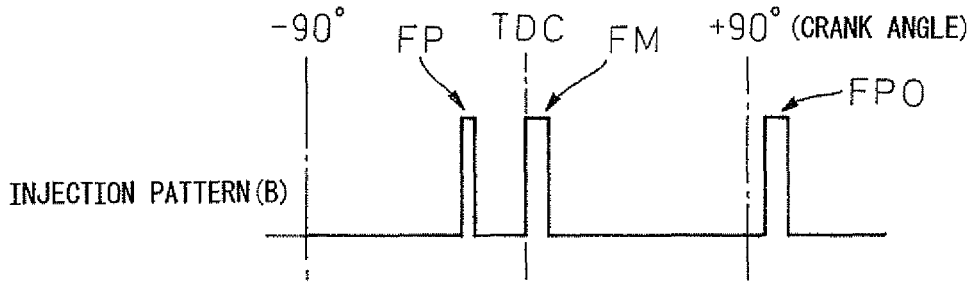
FIG. 14 is an explanatory view of an injection pattern when supplying unburned fuel to an engine exhaust passage.

FIG. 14 shows the injection pattern when supplying unburned fuel to the engine exhaust passage. The injection pattern B performs post injection FPO after the main injection FM. The post injection FPO is injection which is performed at a timing when fuel is not burned in the combustion chambers. The post injection FPO is auxiliary injection. The post injection FPO is, for example, performed in a range of a crank angle after compression top dead center of about 90° to about 120°. By performing the post injection, it is possible to supply the engine exhaust passage with unburned fuel.

In the above explanation, the release of $NO_X$ was explained in the treatment for regeneration of the $NO_X$ storage reduction catalyst, but the invention is not limited to this. The present invention may also be applied even when releasing $SO_X$ which is stored in the $NO_X$ storage reduction catalyst.

The exhaust gas of an internal combustion engine sometimes contains sulfur oxides ($SO_X$). In this case, the $NO_X$ storage reduction catalyst stores $SO_X$ at the same time as storing $NO_X$. If $SO_X$ is stored, the amount of $NO_X$ which can be stored falls. In this way, the $NO_X$ storage reduction catalyst suffers from so-called "sulfur poisoning". To eliminate sulfur poisoning, the $SO_X$ is released for sulfur poisoning recovery treatment. $SO_X$ is stored in the $NO_X$ storage reduction catalyst in a state stabler than $NO_X$. For this reason, in sulfur poisoning recovery treatment, the $NO_X$ storage reduction catalyst is raised in temperature, then $SO_X$ is released by supplying exhaust gas with a rich air-fuel ratio or exhaust gas with a stoichiometric air-fuel ratio.

In the calculation of the amount of $SO_X$ which is stored in the $NO_X$ storage reduction catalyst, in the same way as in the calculation of the amount of $NO_X$ which is stored, a map of the amount of buildup of $SO_X$ per unit time is stored in the electronic control unit as a function of the engine speed and the fuel injection amount. By cumulatively adding the amounts of buildup of $SO_X$ per unit time, it is possible to calculate the amount of buildup of $SO_X$ at any time.

To reverse sulfur poisoning, the temperature of the $NO_X$ storage reduction catalyst is made to rise to a temperature where it can release $SO_X$ and in that state the air-fuel ratio of the exhaust gas which flows into the $NO_X$ storage reduction catalyst is made rich or the stoichiometric air-fuel ratio to thereby make the $NO_X$ storage reduction catalyst release $SO_X$.

When causing $SO_X$ to be released, any device is used to make the temperature of the $NO_X$ storage reduction catalyst rise. Next, at least part of the particulate matter which builds up on the particulate filter is made to burn to produce carbon monoxide. The carbon monoxide which is produced can be supplied as a reducing agent to the $NO_X$ storage reduction catalyst to make it release $SO_X$. In the sulfur poisoning recovery treatment causing $SO_X$ to be released as well, the $NO_X$ storage reduction catalyst may be supplied with a suitable reducing agent. The consumption of fuel when releasing $SO_X$ can therefore be suppressed.

In this regard, in the exhaust purification system of an internal combustion engine of the present embodiment, when causing the $NO_X$ storage reduction catalyst to release $NO_X$, the temperature of the particulate filter is made to rise. The temperature of the exhaust gas which is exhausted from the particulate filter also rises. In the $NO_X$ storage reduction catalyst, $NO_X$ is held in the $NO_X$ absorbent in the state of a salt such as a sulfate. If the temperature of the exhaust gas which flows into the $NO_X$ storage reduction catalyst becomes higher, sometimes the decomposition temperature of the salt of $NO_X$ is exceeded. For example, if the temperature of the exhaust gas which flows into the $NO_X$ storage reduction catalyst becomes higher than the decomposition temperature of sulfate, $NO_X$ ends up being released.

For this reason, the exhaust purification system in the present embodiment is preferably formed so that even if raising the temperature of the particulate filter, the temperature of the $NO_X$ storage reduction catalyst will become less than the decomposition temperature of the salt of $NO_X$. For example, the $NO_X$ storage reduction catalyst and the particulate filter are preferably arranged a predetermined distance from each other. Alternatively, a cooling device for cooling the exhaust gas may be arranged between the particulate filter and the $NO_X$ storage reduction catalyst.

Figure 15:
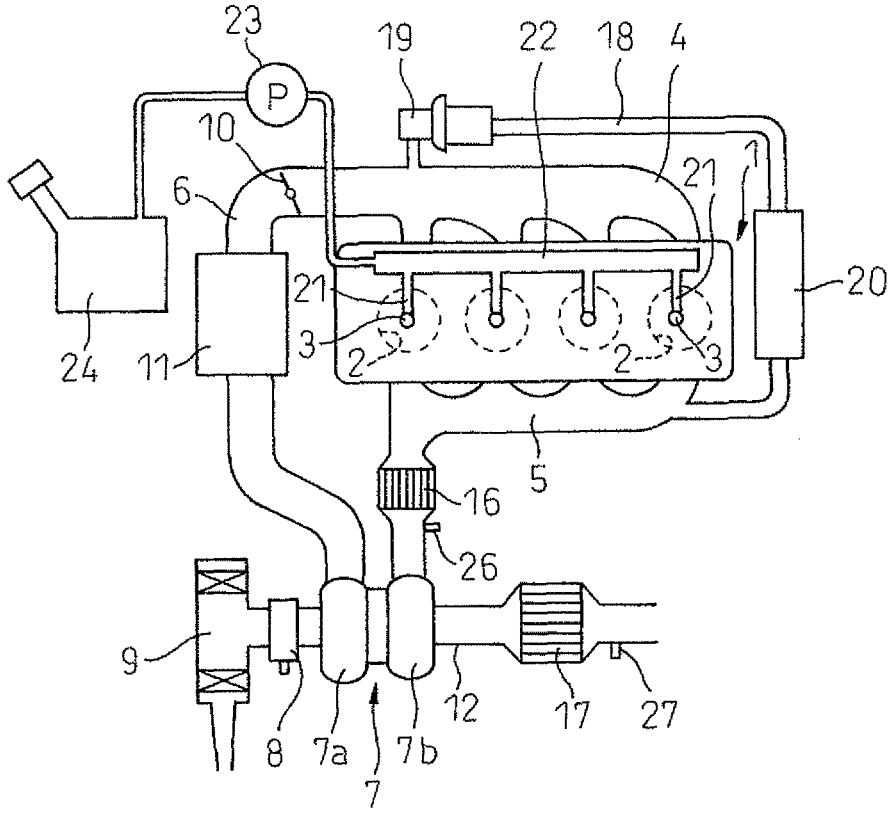
FIG. 15 is a schematic view of another internal combustion engine in Embodiment 1.

FIG. 15 is a schematic view of another internal combustion engine in the present embodiment. In the other internal combustion engine, the particulate filter 16 is arranged in proximity to the exhaust manifold 5. The particulate filter 16 of the other internal combustion engine is a so-called "manifold converter". The particulate filter 16 is arranged at the upstream side of the turbine 7*b*. The particulate filter 16, for example, is arranged in the engine compartment.

The $NO_X$ storage reduction catalyst 17 is arranged at the downstream side of the turbine 7*b*. The $NO_X$ storage reduction catalyst 17 is, for example, arranged under the floor. In this other internal combustion engine, the $NO_X$ storage reduction catalyst 17 and the particulate filter 16 can be arranged sufficiently separated. Even when raising the temperature of the particulate filter and becoming a temperature where carbon monoxide is produced, the $NO_X$ storage reduction catalyst can be maintained at less than the decomposition temperature of the salt.

On the other hand, in the case of sulfur poisoning recovery treatment of the $NO_X$ storage reduction catalyst, the temperature of the $NO_X$ storage reduction catalyst has to be raised. When the rise in temperature of the particulate filter would cause a rise of temperature of the $NO_X$ storage reduction catalyst, the particulate filter is preferably arranged at a distance enabling the bed temperature of the $NO_X$ storage reduction catalyst to be raised to a temperature at which the catalyst can release $SO_X$.

The exhaust purification system in the present embodiment uses the precious metal catalyst which is carried on the particulate filter to raise the temperature of the particulate filter, but the invention is not limited to this. It is sufficient that it be formed so as to be able to raise the temperature of the particulate filter. For example, by arranging an oxidation catalyst at the upstream side of the particulate filter and supplying the oxidation catalyst with unburned fuel, the temperature of the exhaust gas is made to rise. The high temperature exhaust gas may also be used to raise the temperature of the particulate filter.

Alternatively, it is possible to change the injection pattern of the fuel in the combustion chambers to raise the temperature of the particulate filter. For example, it is possible to retard (or delay) the injection timing of the main injection in the combustion chambers to thereby make the temperature of the exhaust gas which is exhausted from the combustion chambers rise. Alternatively, it is possible to perform auxiliary injection at a timing at which combustion is possible after main injection so as to make the temperature of the exhaust gas rise. By raising the temperature of the exhaust gas, it is possible to raise the temperature of the particulate filter.

Embodiment 2

Referring to FIG. 16 to FIG. 19, an exhaust purification system of an internal combustion engine in Embodiment 2 will be explained. The configuration of the internal combustion engine in the present embodiment is similar to the internal combustion engine in Embodiment 1 (see FIG. 1). In the present embodiment as well, carbon monoxide is generated from the particulate matter which builds up on the particulate filter and the $NO_X$ storage reduction catalyst is treated to regenerate it.

In first operational control of the present embodiment, during the time period of normal operational control, the PM buildup of the particulate filter and the $NO_X$ storage amount of the $NO_X$ storage reduction catalyst are adjusted. In the present embodiment, when causing the $NO_X$ storage reduction catalyst to release $NO_X$, control is performed to approach a state where the $NO_X$ and the carbon monoxide which is produced from the particulate matter react in an exact ratio.

Figure 16:
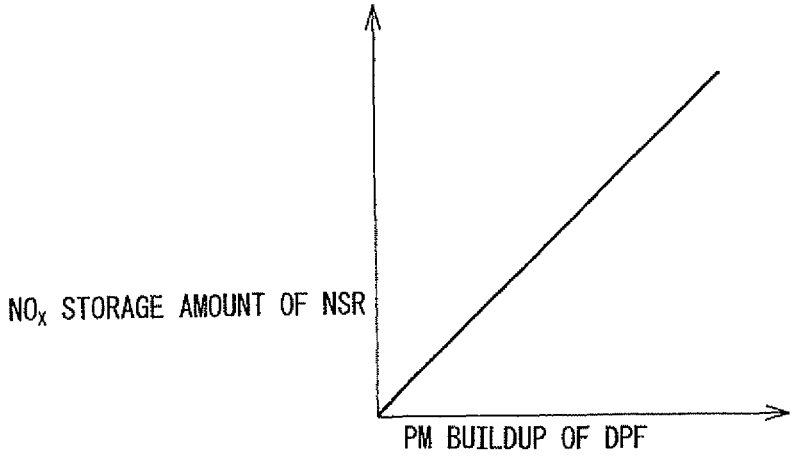
FIG. 16 is a graph which explains a stoichiometric mixture ratio of an amount of $NO_X$ storage of an $NO_X$ storage reduction catalyst and an amount of buildup of particulate matter of a particulate filter in Embodiment 2.

FIG. 16 is a graph of the stoichiometric mixture ratio of the PM buildup at the particulate filter and the $NO_X$ storage amount at the $NO_X$ storage reduction catalyst. It shows a graph at the time when the carbon monoxide which is produced from the particulate matter which builds up on the particulate filter and the $NO_X$ which is stored in the $NO_X$ storage reduction catalyst react in an exact ratio. It is possible to detect the current $NO_X$ storage amount at the $NO_X$ storage reduction catalyst and calculate the PM buildup corresponding to the current $NO_X$ storage amount from the relationship which is shown in FIG. 16.

Figure 17:
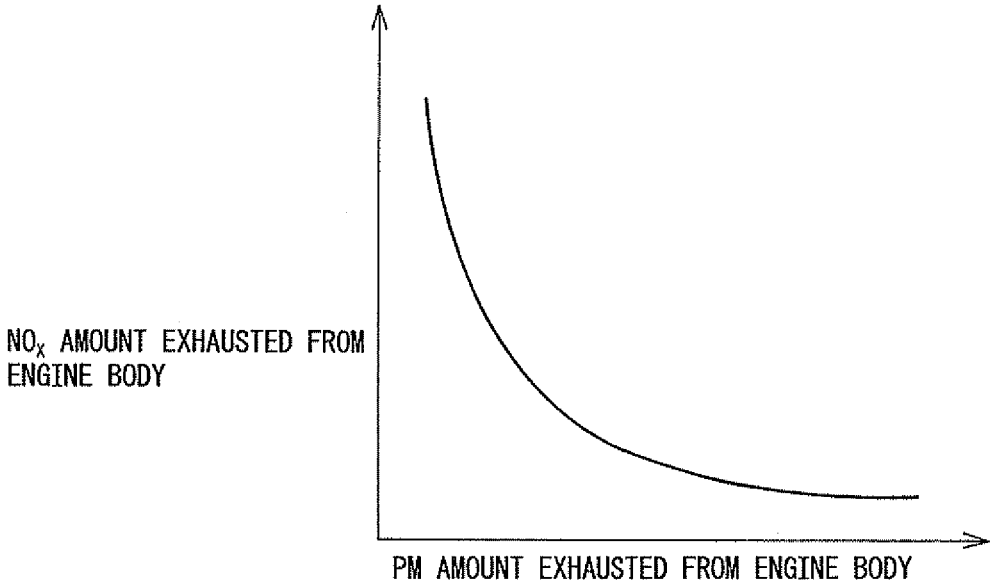
FIG. 17 is a graph which explains a relationship between an amount of $NO_X$ which is discharged from an engine body and an amount of particulate matter in Embodiment 2.

FIG. 17 is a graph for explaining the relationship between the amount of PM which is discharged from the engine body and the amount of $NO_X$ which is discharged from the engine body in the present embodiment. FIG. 17 is a graph of the time when changing the operating state of the internal combustion engine. In the internal combustion engine of the present embodiment, the amount of exhaust of particulate matter which is contained in the exhaust gas and the amount of exhaust of $NO_X$ have mutually contradictory characteristics. If the amount of PM which is exhausted from the engine body increases, the amount of $NO_X$ which is exhausted from the engine body decreases.

To make the amount of $NO_X$ and the amount of PM which are exhausted from the engine body change, for example, it is possible to make the exhaust gas recirculation rate change. Referring to FIG. 1, it is possible to change the opening degree of the EGR control valve 19 so as to change the recirculation rate. If causing the recirculation rate to increase, that is, if increasing the flow rate from the exhaust manifold to the intake manifold, the combustion of the fuel becomes gentler and $NO_X$ is decreased. On the other hand, the amount of particulate matter which is produced increases. Alternatively, to make the amount of $NO_X$ and the amount of PM which are exhausted from the engine body change, it is possible to make the air-fuel ratio at the time of combustion at the combustion chambers 2 change. For example, if raising the air-fuel ratio at the time of combustion, that is, if controlling the combustion air-fuel ratio to the lean side, the amount of PM decreases, but the amount of $NO_X$ increases.

Figure 18:
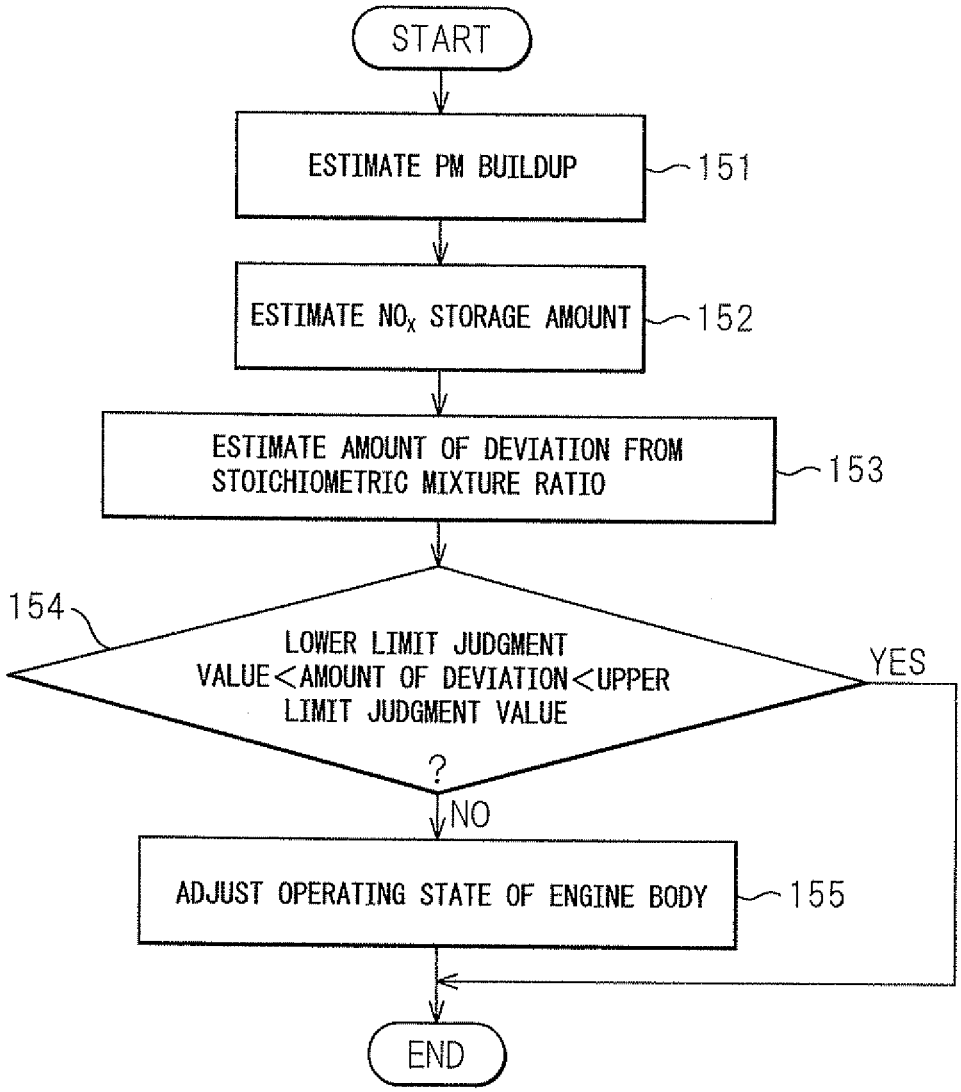
FIG. 18 is a flow chart of control at the time of normal operation of an exhaust purification system in Embodiment 2.

FIG. 18 is a flow chart of control at the time of normal operation of the present embodiment. The control which is shown in FIG. 18 can, for example, be performed at predetermined time intervals.

At step 151, the current PM buildup of the particulate filter is estimated. At step 152, the current $NO_X$ storage amount at the $NO_X$ storage reduction catalyst is estimated. Either the estimation of the PM buildup or the estimation of the $NO_X$ storage amount may be performed first. Alternatively, both may be performed simultaneously.

Next, at step 153, the magnitude of the deviation from the stoichiometric mixture ratio is calculated. In the present embodiment, the target value of the PM buildup at the particulate filter corresponding to the stoichiometric mixture ratio is calculated from the current $NO_X$ storage amount. From the current PM buildup, the target value of the calculated PM buildup is subtracted to calculate the amount of deviation. Alternatively, it is possible to calculate the amount of deviation of the corresponding $NO_X$ storage amount from the PM buildup.

Next, at step 154, it is judged if the calculated amount of deviation is in a predetermined range. It is judged if the amount of deviation is larger than a lower limit side judgment value and smaller than an upper limit side judgment value. For the judgment value of this amount of deviation, for example, a predetermined judgment value may be used. At step 154, when the amount of deviation from the stoichiometric mixture ratio is larger than the lower limit side judgment value and smaller than the upper limit side judgment value, this control is ended. When the amount of deviation is the lower limit side judgment value or less or the upper limit judgment value or more, the routine proceeds to step 155.

At step 155, the operating state of the engine body is controlled so that the $NO_X$ storage amount and the PM buildup approach to a stoichiometric mixture ratio. For example, when the PM buildup of the particulate filter is smaller than the $NO_X$ storage amount of the stoichiometric mixture ratio, the operating state of the engine body is controlled so that the amount of $NO_X$ which is discharged from the engine body is decreased and the amount of particulate matter is increased. For example, the air-fuel ratio at the time of combustion is reduced to make it approach the stoichiometric air-fuel ratio.

As the operating state of the engine body which is changed at step 155, in addition to the air-fuel ratio at the time of combustion, the recirculation rate of the exhaust gas, the injection timing of the fuel, and any other operating state by which the ratio of the amount of particulate matter which is exhausted from the engine body and the amount of $NO_X$ which is discharged from the engine body changes can be employed.

The exhaust purification system of an internal combustion engine in the present embodiment is provided with an adjustment device which adjusts the ratio of $NO_X$ and particulate matter which are present in the exhaust gas which is discharged from the engine body. In the first operational control, the operating state of the engine body is adjusted to perform control so that the PM buildup of the particulate filter and the $NO_X$ storage amount of the $NO_X$ storage reduction catalyst approach the stoichiometric mixture ratio. Due to this control, when the $NO_X$ storage reduction catalyst releases $NO_X$, it is possible to make an amount of particulate matter corresponding to the $NO_X$ amount burn. At the same time as regeneration of the $NO_X$ storage reduction catalyst, the particulate filter can be regenerated and consumption of fuel can be suppressed.

Alternatively, when $NO_X$ should be released, it is possible to avoid the amount of buildup of particulate matter becoming insufficient. The amount of buildup of particulate matter becoming small, the $NO_X$ purification rate falling, and the amount of $NO_X$ release becoming smaller can be avoided. Alternatively, in addition to the release of $NO_X$ by carbon monoxide, it is possible to avoid the release of $NO_X$ by performing separate control.

In the first operational control of the present embodiment, the operation of the engine body is controlled over the entire time period of normal operation so that the PM buildup and the $NO_X$ storage amount become the stoichiometric mixture ratio, but the invention is not limited to this. It is also possible to perform the above control temporarily during the time period of normal operation. For example, in normal operation, to reduce the amount of consumption of fuel, it is possible to continue operation in a state increasing the combustion air-fuel ratio. The amount of $NO_X$ which is discharged from the engine body becomes greater and the amount of PM becomes smaller. For this reason, for example, it is also possible to perform the above control to make the amount of particulate matter which is exhausted from the engine body increase when the PM buildup becomes less than a predetermined judgment value.

Figure 19:
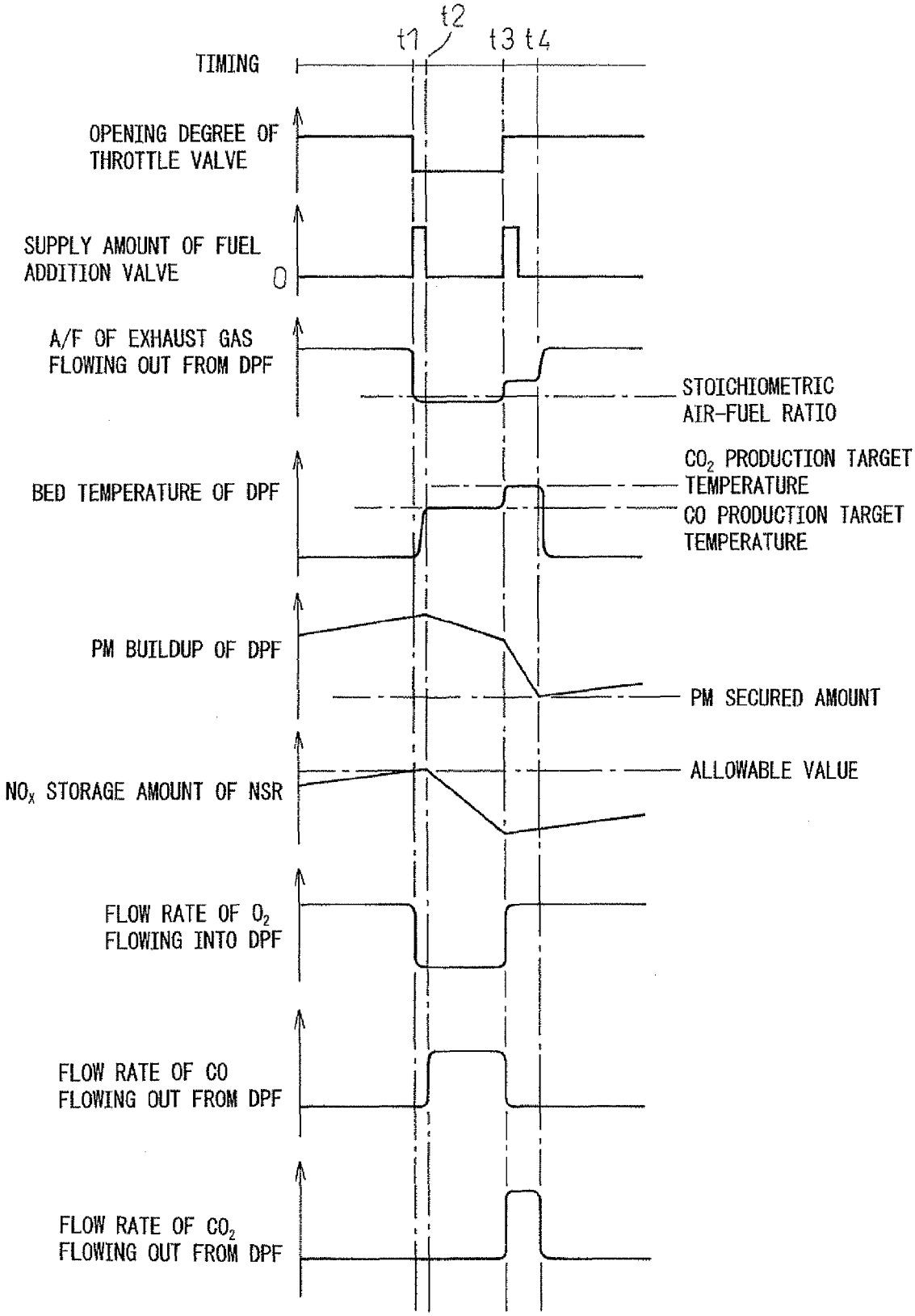
FIG. 19 is a time chart of operational control which makes $NO_X$ be released in Embodiment 2.

FIG. 19 is a time chart of the second operational control in the present embodiment. In the second operational control, when the amount of particulate matter which builds up at the particulate filter is great, the $NO_X$ storage reduction catalyst is made to release $NO_X$, then, further, the particulate matter which builds up on the particulate filter is made to burn.

From the time t1 to the time t3, control is performed to make the $NO_X$ storage reduction catalyst release $NO_X$ in the same way as in first operational control in Embodiment 1. At the time t3, the release of $NO_X$ by the $NO_X$ storage reduction catalyst is ended.

In the second operational control of the present embodiment, the amount of buildup of particulate matter of the particulate filter at the time t3 is detected. When the amount of buildup of particulate matter is greater than a predetermined judgment value, control is performed to further make the particulate matter burn. In this control, control is performed to cause burning until the particulate matter becomes carbon dioxide.

At the time t3, the opening degree of the throttle valve is returned to the opening degree at the time of normal operation. The air-fuel ratio of the exhaust gas which flows into the particulate filter is made lean in state. Fuel is supplied from the fuel addition valve to make the temperature of the particulate filter rise. The temperature of the particulate filter is made to rise to the target temperature at which carbon dioxide is produced.

At the rise in temperature of the particulate filter at the time t3, in addition to supplying fuel by the fuel addition valve, it is possible to change the injection pattern of fuel at the combustion chambers or use another device to make the temperature rise.

By making the bed temperature of the particulate filter rise up to the target temperature of production of carbon dioxide, oxidation of the particulate matter is promoted. Further, by increasing the opening degree of the throttle valve, the exhaust gas will contain a large amount of oxygen. For this reason, in the particulate matter, an oxidation reaction proceeds until carbon dioxide is produced. The carbon dioxide flows out from the particulate filter. When particulate matter excessively builds up in this way, the particulate matter can be made to burn off.

From the time t3 to the time t4, the PM buildup is reduced by burning of the particulate matter. The particulate filter preferably has the amount of particulate matter which is required for the following release of $NO_X$ remaining on it. In the example which is shown in FIG. 19, the particulate matter is burned until the PM buildup becomes a predetermined secured PM amount. At the time t4, the burning of the particulate matter is ended and normal operation is shifted to.

The second operational control in the present embodiment, for example, can be performed in an auxiliary manner when the buildup of PM at the particulate filter becomes large when performing the first operational control in the present embodiment. Alternatively, it is also possible to perform the second operational control without performing the first operational control in the present embodiment.

The rest of the constitution, actions, and effects are similar to those of Embodiment 1, so explanations will not be repeated here.

Embodiment 3

Figure 20:
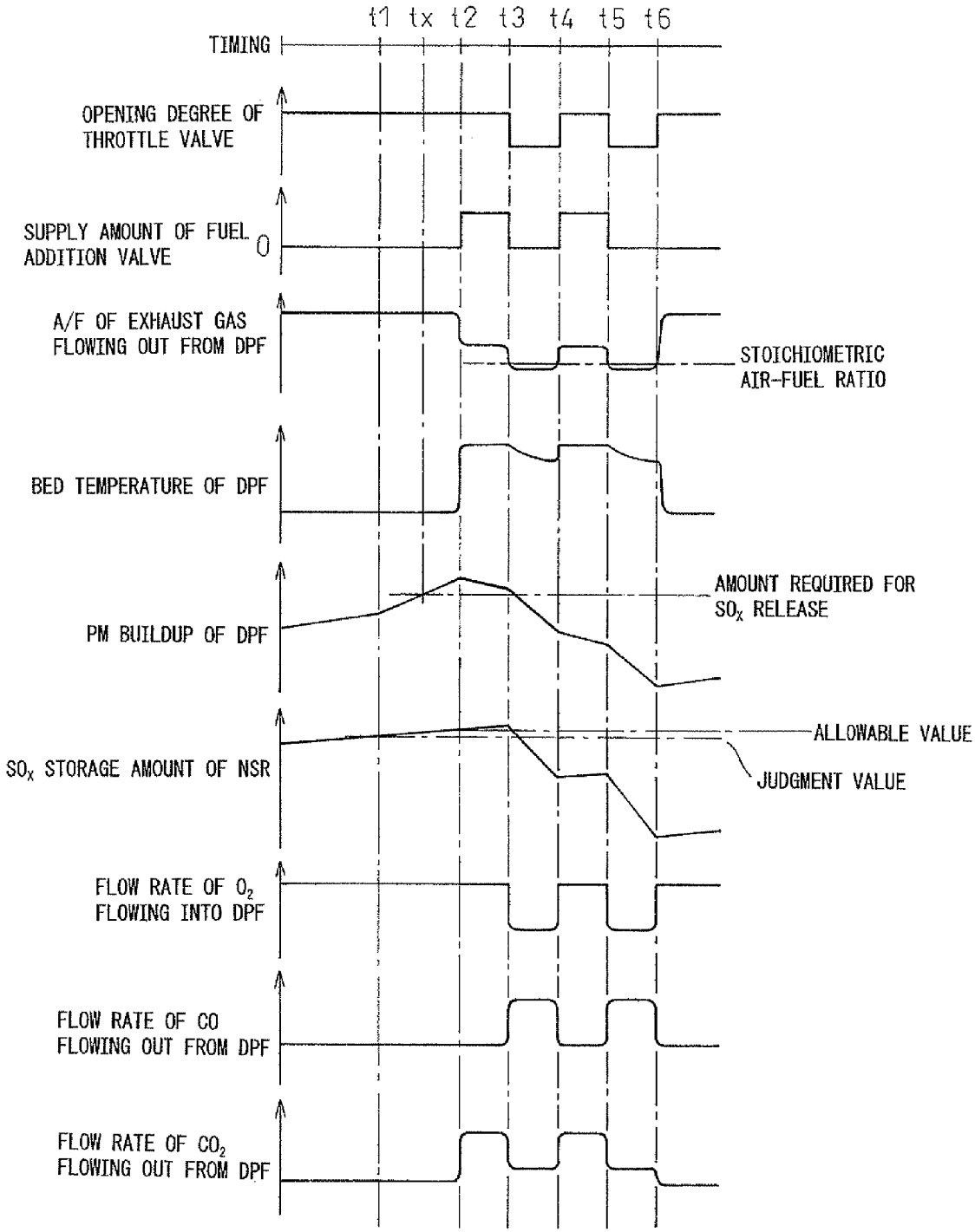
FIG. 20 is a time chart of operational control of sulfur poisoning recovery treatment in Embodiment 3.

Referring to FIG. 20, an exhaust purification system of an internal combustion engine in Embodiment 3 will be explained. The configuration of the internal combustion engine in the present embodiment is similar to that of the internal combustion engine in Embodiment 1 (see FIG. 1). In the present embodiment, sulfur poisoning recovery treatment for causing the $NO_X$ storage reduction catalyst to release the stored $SO_X$ will be explained. In the present embodiment, carbon monoxide production control is performed to release the $SO_X$.

In the sulfur poisoning recovery treatment, it is necessary to raise the $NO_X$ storage reduction catalyst to a temperature at which it can release $SO_X$. If raising the temperature of the particulate filter when raising the temperature of the $NO_X$ storage reduction catalyst, the temperature of the particulate filter becomes a high temperature and the particulate matter burns. For this reason, the particulate matter which builds up on the particulate filter has to be larger in amount than for release of $NO_X$.

In the present embodiment, before causing the $NO_X$ storage reduction catalyst to release $SO_X$, the system detects the PM buildup of the particulate filter and, when the PM buildup of the particulate filter is smaller than the amount necessary for release of $SO_X$, performs control to make the PM buildup increase.

FIG. 20 is a time chart of operational control in the present embodiment. The $SO_X$ amount which is stored in the $NO_X$ storage reduction catalyst at the time of normal operation, for example, in the same way as the $NO_X$ storage amount, can be estimated from a map of the $SO_X$ amount SOXA having the engine speed and the fuel injection amount as functions (see FIG. 6). The $SO_X$ storage amount can be detected at any timing.

At the time t1, the $SO_X$ storage amount of the $NO_X$ storage reduction catalyst reaches a predetermined judgment value. For this judgment value, a value smaller than the allowable value of the $SO_X$ storage amount can be employed.

At the time t1, the system detects the amount of buildup of particulate matter at the particulate filter. When the amount of buildup of particulate matter of the particulate filter is smaller than a predetermined judgment value, control is performed to make the PM buildup speed of the particulate filter increase.

In the present embodiment, as explained in the Embodiment 2, control is performed so that the amount of particulate matter which is exhausted from the engine body increases. For example, by lowering the air-fuel ratio at the time of combustion, it is possible to make the amount of particulate matter which is exhausted from the engine body increase. At the time tx, the PM buildup of the particulate filter reaches the amount necessary for causing the $NO_X$ storage reduction catalyst to release $SO_X$.

At the time t2, the $SO_X$ storage amount at $NO_X$ storage reduction catalyst reaches the allowable value. The sulfur poisoning recovery treatment is started from the time t2. The temperature of the exhaust gas which flows into the $NO_X$ storage reduction catalyst is made to rise from the time t2. In the present embodiment, the fuel addition valve injects fuel to make the temperature of the particulate filter rise. The high temperature exhaust gas which flows out from the particulate filter is used to make the temperature of the $NO_X$ storage reduction catalyst rise. At the time t3, the temperature of the NO storage reduction catalyst reaches the target temperature for release of $SO_X$. In the time period from the time t2 to the time t3, the particulate matter at the particulate filter burns and carbon dioxide is produced.

At the time t3, the opening degree of the throttle valve is reduced to make the flow rate of the exhaust gas which flows into the particulate filter decrease. The air-fuel ratio of the exhaust gas which flows into the particulate filter is made rich. In the particulate filter, a state of insufficient oxygen is formed and carbon monoxide is produced from the particulate matter. The $NO_X$ storage reduction catalyst releases $SO_X$. The $SO_X$ release is continued up to the time t4.

In the example which is shown in FIG. 20, at the time t4, the temperature of the $NO_X$ storage reduction catalyst reaches the lower limit temperature for release of $SO_X$. For this reason, in the time period from the time t4 to the time t5, control is again performed to make the temperature of the exhaust gas rise. The temperature of the particulate filter is made to rise so as to make the temperature of the $NO_X$ storage reduction catalyst rise.

From the time t5 to the time t6, $SO_X$ is again released. At the time t6, the amount of release of $SO_X$ reaches a predetermined amount and the sulfur poisoning recovery treatment is ended. The amount of release of $SO_X$ can be estimated from a map etc. in the same way as the amount of release of $NO_X$. From the time t6 on, normal operation is performed.

In this way, before the release of $SO_X$ at the $NO_X$ storage reduction catalyst, the amount of buildup of particulate matter at the particulate filter is adjusted so as to avoid the particulate matter becoming insufficient for release of $SO_X$. It is possible to avoid a sufficient amount of $SO_X$ no longer being able to be released. The PM buildup secured when the release of $SO_X$ ends is preferably an amount necessary for the following release of $NO_X$.

In the present embodiment, when the $SO_X$ storage amount at the $NO_X$ storage reduction catalyst reaches a predetermined judgment value, the system detects the PM buildup at the particulate filter and performs control to make the PM buildup speed increase, but the invention is not limited to this. When sulfur poisoning recovery treatment should be started, it is possible to perform control so that the PM buildup becomes larger than the amount required for release of $SO_X$. For example, when performing control to make the PM buildup at the particulate filter decrease after the control for making the $NO_X$ be released at the $NO_X$ storage reduction catalyst, this control may also be suspended. That is, the amount of particulate matter burned may also be decreased.

Further, in the present embodiment, the rise in temperature of the particulate filter is used to raise the temperature of the $NO_X$ storage reduction catalyst, but the invention is not limited to this. Any device may be used to raise the temperature of the $NO_X$ storage reduction catalyst. For example, it is also possible to arrange another fuel addition valve and oxidation catalyst between the particulate filter and the $NO_X$ storage reduction catalyst and to supply fuel from the fuel addition valve to the oxidation catalyst so as to make the temperature of the exhaust gas which flows into the $NO_X$ storage reduction catalyst rise.

The rest of the constitution, actions, and effects are similar to those of Embodiment 1 or 2, so explanations will not be repeated here.

Embodiment 4

Figure 21:
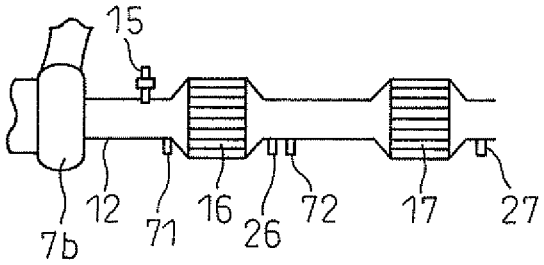
FIG. 21 is a schematic view of an exhaust purification system of an internal combustion engine in Embodiment 4.
Figure 22:
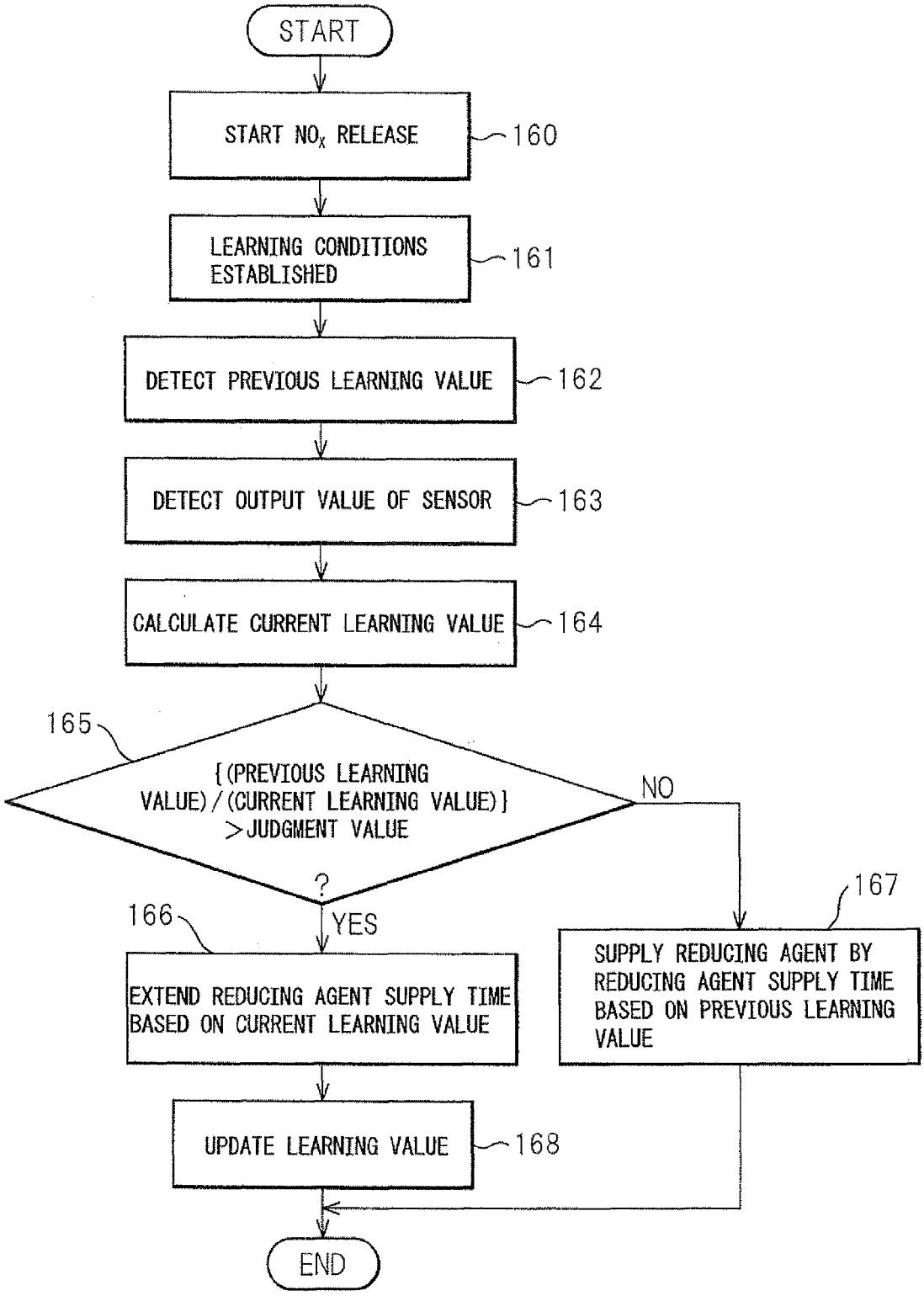
FIG. 22 is a flow chart for when performing control which produces carbon monoxide in Embodiment 4.

Referring to FIG. 21 and FIG. 22, an exhaust purification system of an internal combustion engine in Embodiment 4 will be explained. The exhaust purification system of the internal combustion engine of the present embodiment estimates the ability of the particulate filter to produce carbon monoxide and changes the operating conditions in accordance with the ability to produce carbon monoxide.

FIG. 21 is a schematic view of part of the exhaust pipe of the exhaust purification system of an internal combustion engine in the present embodiment. The exhaust purification system of the present embodiment is provided with the deterioration degree detection system which detects the degree of deterioration of the ability to oxidize particulate matter. The deterioration degree detection system of the present embodiment includes oxygen sensors 71 and 72 which are arranged at the upstream side and the downstream side of the particulate filter. The outputs of the oxygen sensors 71 and 72 are input to the electronic control unit 30 (see FIG. 1). The oxygen sensors 71 and 72 are arranged so as to be able to detect the oxygen concentration of the exhaust gas which flows into the particulate filter 16 and the oxygen concentration of the exhaust gas which flows out from the particulate filter.

The particulate filter 16 in the present embodiment is comprised of a base material on which a metal catalyst which has an oxidation function is carried. The particulate filter 16 in the present embodiment is comprised of a base material on which platinum is carried.

If continuing to use the exhaust purification system, sometimes the oxidation ability of the particulate filter deteriorates. For example, sometimes sintering occurs when the temperature of the exhaust gas around the metal catalyst is high and the atmosphere around the metal catalyst has an excess of air. Sintering is the phenomenon where the platinum or other metal particles which are carried on the base material of the exhaust treatment device bind together resulting in the particle size becoming larger, the sum of the surface areas of the metal particles becoming smaller, and the purification ability falling.

The exhaust purification system of an internal combustion engine in the present embodiment detects the degree of deterioration of the particulate filter from the state of production of carbon monoxide at the particulate filter. The operating conditions at the time of production of carbon monoxide are changed in accordance with the degree of deterioration of the particulate filter.

FIG. 22 is a flow chart of the operational control in the present embodiment. In the present embodiment, the degree of deterioration of the particulate filter is detected during the time period of release of $NO_X$.

The "learning value" in the present embodiment is a variable which expresses the degree of deterioration of the particulate filter. The learning value is for example stored in the electronic control unit 30 (see FIG. 1). As the learning value, the value of the oxygen concentration at the upstream side of the particulate filter minus the oxygen concentration at the downstream side of the particulate filter is employed. The learning value is not limited to this. Any variable which expresses the degree of deterioration of the particulate filter may be employed.

At step 160, carbon monoxide production control for release of $NO_X$ is started. At the particulate filter, the particulate matter is oxidized and carbon monoxide is produced. At step 161, the conditions for learning are established. At step 161, the internal combustion engine is preferably being operated in a predetermined operating state. At step 162, the previous learning value is detected.

Next, at step 163, the output values of the oxygen sensors 71 and 72 which are arranged before and after the particulate filter 16 are detected. The current oxygen concentrations at the upstream side and the downstream side of the particulate filter 16 are detected. At step 164, the current learning value is calculated from the current oxygen concentrations which are detected. For example, as the learning value, the value of the upstream side oxygen concentration minus the downstream side oxygen concentration is calculated.

Next, at step 165, to what extent the deterioration of the oxidation ability of the particulate filter etc. has progressed is calculated. In the example of control which is shown in FIG. 22, the ratio of the current learning value to the previous learning value is calculated. It is judged if this ratio is larger than a judgment value. When deterioration of the oxidizing ability of the particulate filter progresses, the difference between the upstream side oxygen concentration and the downstream side oxygen concentration gradually becomes smaller. If the deterioration of the oxidizing ability progresses, the amount of oxygen which is consumed inside of the filter becomes smaller, so the decrease in the oxygen concentration becomes smaller.

When, at step 165, the ratio of the previous learning value to the current learning value is larger than a predetermined judgment value, the routine proceeds to step 166. At step 166, the operating state when causing $NO_X$ to be released from the $NO_X$ storage reduction catalyst is determined based on the current learning value. In the present embodiment, the current learning value is used as the basis to calculate the reducing agent feed time. That is, the time for production of carbon monoxide is calculated. The reducing agent supply time based on the current learning value becomes longer than the reducing agent supply time based on the previous learning value. $NO^X$ is released based on the reducing agent supply time which was calculated. In this way, the time for supply of the reducing agent is extended. At step 168, the learning value is updated.

When, at step 165, the ratio of the previous learning value to the current learning value is the predetermined judgment value or less, the routine proceeds to step 167. At step 167, the previous learning value is used as the basis to set the reducing agent supply time period. For the reducing agent supply time period, a time period the same as for the previous release of $NO_X$ is employed. The time period is used as the basis for supply of the reducing agent.

In this way, in the present embodiment, the degree of deterioration of the ability of the trapping filter to produce carbon monoxide is detected. The larger the degree of deterioration, the longer the time for production of carbon monoxide in the carbon monoxide production control.

If the oxidizing ability at the particulate filter degrades, the amount of the carbon monoxide which is produced at the particulate filter becomes smaller. As a result, sometimes the release of $NO_X$ from the $NO_X$ storage reduction catalyst becomes insufficient. The exhaust purification system of an internal combustion engine in the present embodiment can select the operating state when producing carbon monoxide in accordance with the deterioration of the particulate filter. Even when deterioration of the particulate filter progresses, a sufficient amount of carbon monoxide can be supplied to the $NO_X$ storage reduction catalyst. As a result, the desired $NO_X$ release can be performed.

In the present embodiment, as the deterioration degree detection system, oxygen sensors are arranged, but the invention is not limited to this. The deterioration degree detection system can employ any device able to estimate the oxidizing ability of the particulate filter.

As the deterioration degree detection system, a temperature sensor may be arranged at the upstream side and the downstream side of the particulate filter. The more actively the oxidation reaction occurs, the more the temperature of the exhaust gas rises. The fact of this temperature rise becoming smaller may be used to judge that the oxidizing ability of the particulate filter is deteriorating. For example, it is possible to detect the temperature difference of the inlet and outlet of the particulate filter to thereby detect the oxidizing ability at the particulate filter.

Alternatively, the deterioration degree detection system may include a differential pressure sensor which detects the pressure difference at the upstream side and the downstream side of the particulate filter. The differential pressure sensor may be used to detect the amount of particulate matter which builds up at the particulate filter. When producing carbon monoxide, the amount of buildup of particulate matter is decreased, so the differential pressure before and after the particulate filter falls. For example, it is possible to detect the fact of the amount of fall at the differential pressure sensor in a predetermined time becoming small to thereby judge the degree of deterioration of the oxidizing ability of the particulate filter becoming larger.

Furthermore, the deterioration degree detection system may include an air-fuel ratio sensor (A/F sensor) which is arranged at the upstream side and the downstream side of the particulate filter. The air-fuel ratio sensor can judge the oxygen storage ability of the catalyst. The judgment of the oxygen storage ability may be used to estimate the degree of deterioration of the oxidizing ability of the particulate filter.

The operational control in the present embodiment is performed during the time period of release of $NO_X$, but the invention is not limited to this. For example, this may also be performed in the time period of release of $SO_X$. Further, in the present embodiment, the system detects the degree of deterioration during the time period of current release of $NO_X$ and performs control to extend the time period of current production of the carbon monoxide, but the invention is not limited to this. It is also possible to perform control to increase the time period of production of carbon monoxide from the next release of $NO_X$.

The rest of the constitution, actions, and effects are similar to those of any of Embodiments 1 to 3, so explanations will not be repeated here.

Embodiment 5

Figure 23:
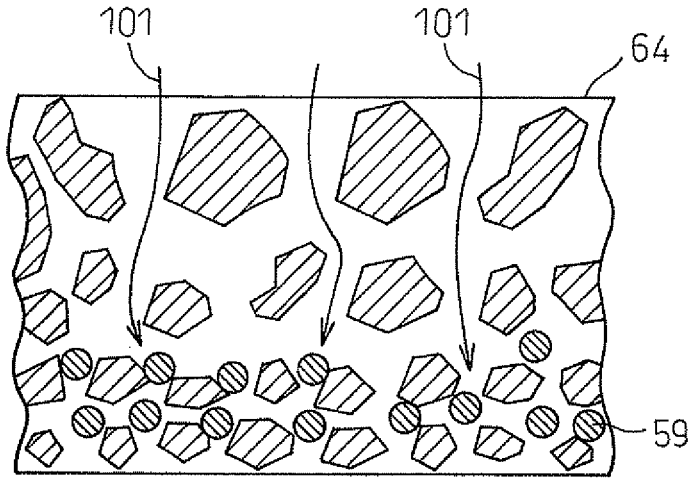
FIG. 23 is an enlarged schematic cross-sectional view of partition walls of a first particulate filter in Embodiment 5.
Figure 24:
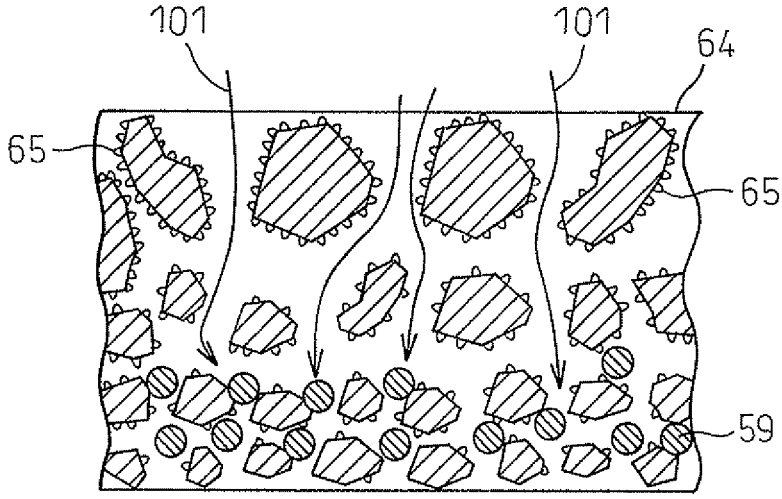
FIG. 24 is an enlarged schematic cross-sectional view of partition walls of a second particulate filter in Embodiment 5.

Referring to FIG. 23 and FIG. 24, an exhaust purification system of an internal combustion engine in Embodiment 5 will be explained. In the present embodiment, the structure of a particulate filter will be explained.

FIG. 23 is an enlarged schematic cross-sectional view of partition walls of a first particulate filter in the present embodiment. The exhaust gas and particulate matter 59, as shown by the arrow 101, flow from the inflow surfaces of the partition walls 64. The first particulate filter is formed so that the porosity of the partition walls 64 becomes smaller at the outflow surfaces of the exhaust gas compared with the inflow surfaces. In the example which is shown in FIG. 23, the porosity of the insides of the partition walls 64 of the particulate filter is formed to gradually become smaller from the inflow surfaces toward the outflow surfaces. The partition walls 64 are formed so that the inflowing particulate matter 59 is trapped near the outflow surfaces. More particulate matter 59 is built up at the outflow side region of the partition walls 64 than the inflow side region.

Inside of the partition walls 64, oxygen is consumed by the oxidation of unburned fuel which is contained in the exhaust gas. For example, when a precious metal catalyst is carried at the partition walls 64, the precious metal catalyst is used to promote the oxidation reaction of the unburned fuel. The oxygen concentration which is contained in the exhaust gas gradually becomes smaller from the inflow surfaces toward the outflow surfaces of the partition walls 64. For this reason, the oxygen concentration becomes smaller in the outflow side region of the partition walls where the particulate matter 59 is built up. The particulate matter 59 is supplied with exhaust gas in which oxygen is consumed. For this reason, production of carbon monoxide can be promoted.

FIG. 24 is an enlarged schematic cross-sectional view of the partition walls of the second particulate filter in the present embodiment. The second particulate filter is formed so that the oxidizing power at the inflow side region of the exhaust gas becomes larger than the oxidizing power of the outflow side region. In the example shown in FIG. 24, the amount of catalyst carried is changed. At the inflow regions of the exhaust gas, a large amount of metal catalyst comprised of the precious metal catalyst 65 is carried. The amount carried is gradually reduced the further toward the outflow surfaces of the exhaust gas.

In the second particulate filter, the reaction between the unburned fuel and oxygen which are contained in the exhaust gas is promoted at the inflow side region of the partition walls 64. For this reason, the particulate matter 59 which builds up at the outflow region of the exhaust gas is supplied with exhaust gas in which oxygen has been consumed. For this reason, production of carbon monoxide can be promoted.

The second particulate filter in the present embodiment is formed so that the amount of metal catalyst carried, which promotes the oxidation reaction, becomes gradually smaller from the inflow surfaces to the outflow surfaces of the exhaust gas, but the invention is not limited to this. It may also be formed so that the oxidizing ability changes in stages. For example, it is also possible to divide the partition walls into two regions along the direction of flow of the exhaust gas, have a precious metal catalyst carried at the inflow side region, and have a base metal catalyst carried at the outflow side region.

The rest of the constitution, actions, and effects are similar to those of any of Embodiments 1 to 4, so explanations will not be repeated here.

Embodiment 6

Figure 25:
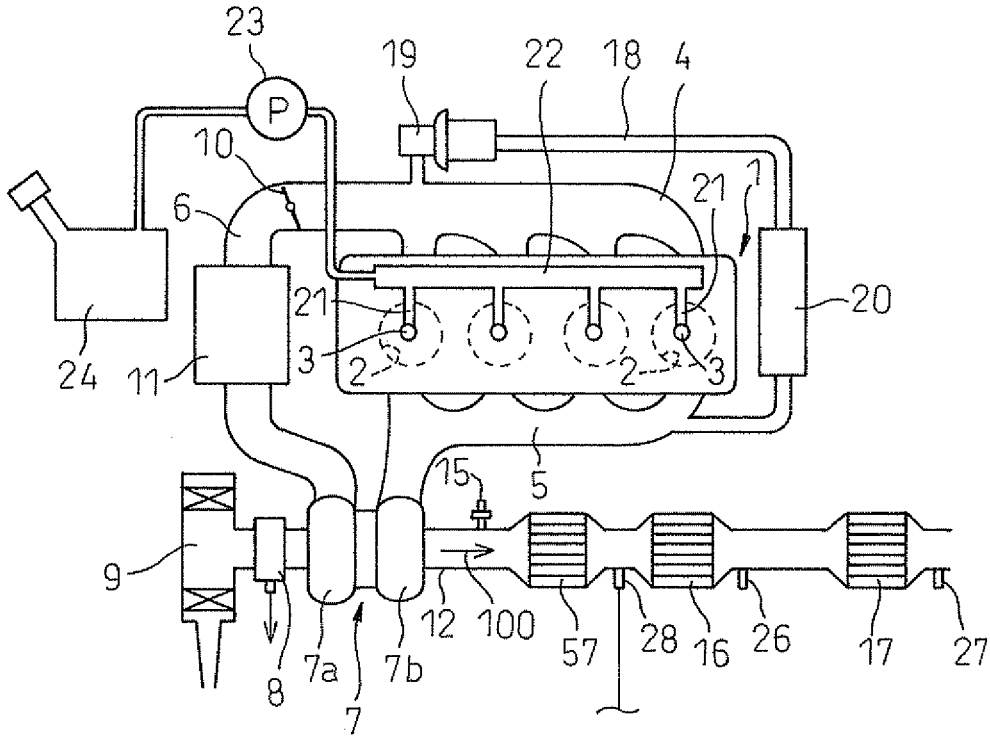
FIG. 25 is a schematic view of a first internal combustion engine in Embodiment 6.
Figure 26:
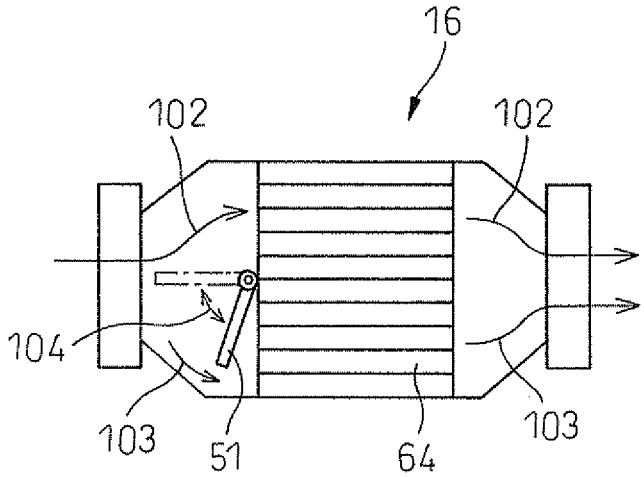
FIG. 26 is a schematic cross-sectional view of a particulate filter of a second internal combustion engine in Embodiment 6.

Referring to FIG. 25 and FIG. 26, an exhaust purification system of an internal combustion engine in Embodiment 6 will be explained.

FIG. 25 is a schematic view of a first internal combustion engine in the present embodiment. In the first exhaust purification system of an internal combustion engine of the present embodiment, at the upstream side of the particulate filter 16, a further particulate filter 57 is arranged. At the downstream side of the particulate filter 57, a temperature sensor 28 which detects the temperature of the particulate filter 57 is arranged. The output of the temperature sensor 28 is input to the electronic control unit 30 (see FIG. 1). The fuel addition valve 15 in the present embodiment is arranged at the upstream side from the other particulate filter 57.

The upstream side particulate filter 57 is formed so as to pass part of the particulate matter which is exhausted from the engine body. For example, part of the passages among the plurality of passages are formed so that the particulate matter can pass through them. The particulate matter which passes through the upstream side particulate filter 57 is trapped at the downstream side particulate filter 16.

The upstream side particulate filter 57 is formed so that the oxidizing ability of the unburned fuel becomes larger than the oxidizing ability of the downstream side particulate filter 16. In the present embodiment, the upstream side particulate filter 57 carries a metal catalyst comprised of a precious metal catalyst. In the downstream side particulate filter 16, a catalyst with a smaller oxidizing power than the particulate filter 57 is arranged. For example, as the catalyst, base metal particles are carried. Alternatively, the upstream side particulate filter 57 may have an HC trap function of holding the unburned fuel so that the oxidizing ability becomes larger. For example, at the upstream side particulate filter 57, the surface of the base material may be coated with zeolite etc.

The upstream side particulate filter 57 can mainly oxidize the unburned fuel which is contained in the exhaust gas. The downstream side particulate filter 16 can mainly produce the carbon monoxide which is supplied to the $NO_X$ storage reduction catalyst 17.

In the exhaust purification system of an internal combustion engine in the present embodiment, the oxidizing ability of the upstream side particulate filter 57 is superior. In the particulate filter 57, the unburned fuel which is contained in the exhaust gas is oxidized. At this time, the oxygen which is contained in the exhaust gas is consumed. At the upstream side particulate filter 57, the unburned fuel is burned and mainly carbon dioxide is produced.

The oxygen concentration of the exhaust gas which is supplied to the downstream side particulate filter 16 becomes small. In the particulate filter 16, the production of carbon monoxide can be promoted. At the downstream side particulate filter 16, it is possible to make the particulate matter burn in an oxygen-poor state and more effectively produce carbon monoxide. In this way, a plurality of particulate filters may be arranged in series.

In the present embodiment, two particulate filters are connected, but the invention is not limited to this. It is also possible to arrange an exhaust treatment device with an excellent oxidizing ability of unburned fuel at the upstream side of the particulate filter. For example, it is possible to arrange an HC trap catalyst at the upstream side of the particulate filter.

FIG. 26 is an enlarged schematic cross-sectional view of a particulate filter in a second exhaust purification system of an internal combustion engine in the present embodiment. The particulate filter 16 of the second exhaust purification system of an internal combustion engine includes a member for causing the flow of exhaust gas at the inside to slant to one side.

The particulate filter 16 includes a flow rate adjusting member 51 which is arranged in the inflow side space. The flow rate adjusting member 51 in the present embodiment is formed into a flat plate shape. The flow rate adjusting member 51, as shown by the arrow 104, is formed to be able to pivot. At the time of normal operation, the flow rate adjusting member 51 is arranged so that the direction of flow of the exhaust gas and the maximum area surface where the area becomes maximum become substantially parallel. The flow rate adjusting member 51 is arranged at a neutral position. In the carbon monoxide production control, the flow rate adjusting member 51 is pivoted whereby a region with a large flow sectional area and a region with a small flow sectional area are formed.

As shown by the arrow 102, exhaust gas flows to the region with a larger flow sectional area. Further, as shown by the arrow 103, exhaust gas flows to the region with a small flow sectional area. The exhaust gas which passes through the region with a small flow sectional area becomes smaller in flow rate. The amount of oxygen which flows in is decreased. In this way, an oxygen-poor state is created by reducing the flow rate of the exhaust gas which flows through part of the particulate filter. It is possible to promote the production of carbon monoxide. The exhaust gas which flows as shown by the arrow 103 contains a large amount of carbon monoxide. This carbon monoxide can be supplied to the downstream. $NO_X$ storage reduction catalyst.

Regarding the time at which the flow rate adjusting member is made to pivot from the neutral position, for example, this is preferably after the addition of fuel by the fuel addition valve makes the temperature of the particulate filter rise and particulate matter which is built up starts to burn. That is, this is preferably after the particulate matter ignites. By causing the flow rate adjusting member to pivot to one side, when the particulate matter continues to burn, a region of insufficient oxygen is formed and production of carbon monoxide can be promoted.

The flow rate adjusting member in the present embodiment is formed so that a plate-shaped member can be pivoted, but the invention is not limited to this. It is possible to divide the particulate filter into a plurality of regions and employ any member which can reduce the flow rate of the exhaust gas which flows through at least one region.

The rest of the constitution, actions, and effects are similar to those of any of Embodiments 1 to 5, so explanations will not be repeated here.

Embodiment 7

Figure 27:
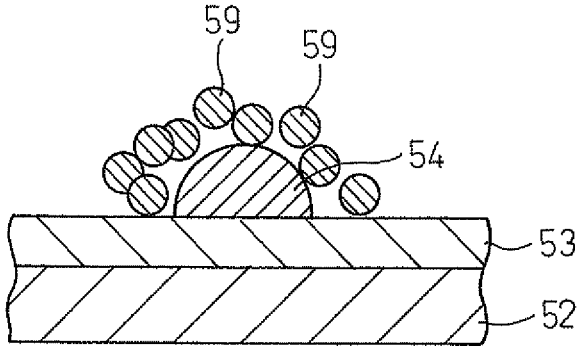
FIG. 27 is an enlarged schematic cross-sectional view of partition walls of a first particulate filter in Embodiment 7.
Figure 28:
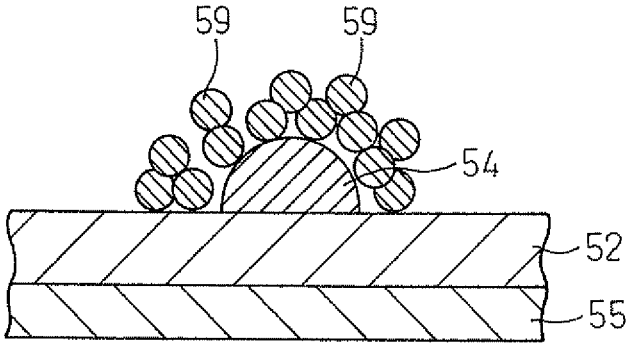
FIG. 28 is an enlarged schematic cross-sectional view of partition walls of a second particulate filter in Embodiment 7.

Referring to FIG. 27 and FIG. 28, an exhaust purification system of an internal combustion engine of Embodiment 7 will be explained. In the present embodiment, the structure of a particulate filter will be explained.

FIG. 27 is an enlarged schematic cross-sectional view of the partition walls of the first particulate filter in the present embodiment. At the partition walls of the first particulate filter in the present embodiment, an oxygen storing material 53 is arranged at the surface of the base material 52. The oxygen storing material 53 is formed by a material which has the ability to store oxygen. For example, the oxygen storing material 53 includes ceria or zirconia etc. Further, at the partition walls, an oxidation catalyst comprised of a base metal catalyst 54 is arranged. As the base metal catalyst 54, iron etc. may be used. The catalyst is not limited to this. Platinum or another precious metal may also be used.

The oxygen storing material 53 in the present embodiment is formed so as to store the amount of oxygen required for ignition of the particulate matter 59. When the particulate matter 59 is ignited, the oxygen of the oxygen storing material 53 is used. The oxygen storing material 53 is formed so that after the particulate matter 59 is ignited, the amount of oxygen which is contained in the oxygen storing material 53 becomes substantially zero.

In the present embodiment, the air-fuel ratio of the exhaust gas which flows into the particulate filter is rich. When the particulate matter 59 starts to burn, not only oxygen which is contained in the exhaust gas, but also oxygen from the oxygen storing material 53 is supplied. For this reason, combustion of the particulate matter 59 can be easily started. That is, the particulate matter 59 can be easily ignited. After the particulate matter 59 is ignited, the oxygen which is supplied from the oxygen storing material 53 is consumed and an oxygen-poor atmosphere is formed. After this, the particulate matter burns in a state of insufficient oxygen. For this reason, carbon monoxide can be efficiently produced.

FIG. 28 is an enlarged schematic cross-sectional view of the partition walls of the second particulate filter in the present embodiment. The second particulate filter includes a heating device which directly heats the base material 52. In the second particulate filter, the base material 52 has a heater comprised of a heater 55 attached to it. At the surface of the base material 52, a metal catalyst is arranged. In the present embodiment, a base metal catalyst 54 is arranged.

If particulate matter 59 builds up at the particulate filter, sometimes the particulate matter 59 ends up covering the surroundings of the base metal catalyst 54 which is arranged at the surface of the base material 52. In this case, for example, even if supplying fuel to the particulate filter in an excess air atmosphere, the fuel will not contact the base metal catalyst 54 and oxidation of the unburned fuel will be inhibited. That is, base metal catalyst 54 will not sufficiently contact the unburned fuel and air and an oxidation reaction of the unburned fuel will no longer be promoted. For this reason, it will become harder for the temperature of the particulate filter to rise.

In such a case as well, by operating the heater 55, the temperature of the base material 52 can be raised. By causing the temperature of the catalyst to rise to the carbon monoxide production temperature, then making the air-fuel ratio of the exhaust gas rich, it is possible to create an oxygen-poor state and burn the particulate matter 59. It is possible to produce carbon monoxide from the particulate matter 59.

Further, since the particulate filter can be easily raised in temperature, it is possible to use a base metal with a small oxidizing power to form the catalyst without using an expensive metal such as a precious metal with a strong oxidizing power.

The rest of the constitution, actions, and effects are similar to those of any of any of Embodiments 1 to 6, so explanations will not be repeated here.

The above embodiments can be suitably combined. In the above figures, the same or corresponding parts are assigned the same reference signs. Note that, the above embodiments are illustrative and do not limit the invention. Further, in the embodiments, all changes included in the claims are intended.

REFERENCE SIGNS LIST

1 engine body
2 combustion chamber
3 fuel injector
8 intake air detector
10 throttle valve
12 exhaust pipe
13 exhaust throttle valve
15 fuel addition valve
16 particulate filter
17 $NO_X$ storage reduction catalyst
18 EGR passage
19 EGR control valve
57 particulate filter
30 electronic control unit

The invention claimed is:

1. An exhaust purification system of an internal combustion engine, comprising:

an $NO_X$ storage reduction catalyst which is arranged in an engine exhaust passage, which stores $NO_X$ which is contained in exhaust gas when an air-fuel ratio of the exhaust gas is lean, and which releases stored $NO_X$ when an air-fuel ratio of inflowing exhaust gas becomes a stoichiometric air-fuel ratio or rich, a trapping filter which is arranged at an upstream side of the $NO_X$ storage reduction catalyst and which traps particulate matter which is contained in the exhaust gas, and an electronic control unit;

wherein when causing the $NO_X$ storage reduction catalyst to release the stored $NO_X$ or $SO_X$, the electronic control unit is configured to raise the trapping filter to a temperature at which at least part of the particulate matter is oxidized, make the flow rate of the exhaust gas which flows into the trapping filter drop, make the air-fuel ratio of the exhaust gas fall so that the air-fuel ratio of the exhaust gas which flows out from the trapping filter becomes the stoichiometric air-fuel ratio or rich, make the particulate matter which builds up on the trapping filter oxidize to generate carbon monoxide as carbon monoxide production control to thereby supply the $NO_X$ storage reduction catalyst with carbon monoxide, and adjust a ratio of the $NO_X$ and particulate matter present in the exhaust gas which is discharged from the engine body so that carbon monoxide which is produced from the particulate matter which builds up on the trapping filter and the $NO_X$ which builds up at the $NO_X$ storage reduction catalyst become a stoichiometric mixture ratio.

2. An exhaust purification system of an internal combustion engine as set forth in claim 1, wherein the electronic control unit is configured to make the air-fuel ratio of the exhaust gas which flows into the trapping filter rich.

3. An exhaust purification system of an internal combustion engine as set forth in claim 1, wherein the electronic control unit is configured to detect the amount of particulate matter which builds up on the trapping filter when the carbon monoxide production control ends and, when the amount of particulate matter is larger than a judgment value, raise the trapping filter to the temperature at which the particulate matter is oxidized to carbon dioxide or more and make the air-fuel ratio of the exhaust gas which flows into the trapping filter lean to thereby make the particulate matter burn.

4. An exhaust purification system of an internal combustion engine as set forth in claim 1, wherein the electronic control unit is configured to make the $NO_X$ storage reduction catalyst rise to a temperature at which it can release $SO_X$ and perform carbon monoxide production control so as to make the catalyst release $SO_X$ as sulfur poisoning recovery treatment, and the electronic control unit is configured to detect the $SO_X$ amount which is stored in the $NO_X$ storage reduction catalyst before the sulfur poisoning recovery treatment and make the amount of particulate matter which is exhausted from the engine body increase or make the amount of particulate matter which is burned decrease so that the amount of particulate matter which is required for the sulfur poisoning recovery treatment builds up at the trapping filter.

5. An exhaust purification system of an internal combustion engine as set forth in claim 1, wherein the electronic control unit is configured to detect a degree of deterioration of the ability of the trapping filter to oxidize the particulate matter, detect the degree of deterioration of the ability of the trapping filter to produce carbon monoxide, and make the time of production of carbon monoxide longer the larger the degree of deterioration.

6. An exhaust purification system of an internal combustion engine as set forth in claim 1, wherein the electronic control unit is configured to make the opening degree of a valve of at least one of a throttle valve which is arranged in an engine intake passage and an exhaust throttle valve which is arranged in the engine exhaust passage smaller so as to thereby cause a drop in the flow rate of the exhaust gas which flows into the trapping filter.

* * * * *